US011225954B2

(12) United States Patent
Zhu et al.

(10) Patent No.: US 11,225,954 B2
(45) Date of Patent: Jan. 18, 2022

(54) SYSTEM AND METHOD FOR MULTI-LEVEL VACUUM GENERATION AND STORAGE

(71) Applicant: New Jersey Institute of Technology, Newark, NJ (US)

(72) Inventors: Chao Zhu, Edison, NJ (US); Zhiming Ji, Whippany, NJ (US); Mengchu Zhou, Basking Ridge, NJ (US); Joseph Glaz, Fair Lawn, NJ (US); Bo Zhang, Kearny, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 148 days.

(21) Appl. No.: 16/821,275

(22) Filed: Mar. 17, 2020

(65) Prior Publication Data

US 2020/0325882 A1 Oct. 15, 2020

Related U.S. Application Data

(63) Continuation-in-part of application No. 15/617,612, filed on Jun. 8, 2017, now abandoned.

(Continued)

(51) Int. Cl.

| | |
|---|---|
| ***F04B 35/00*** | (2006.01) |
| ***F04B 39/06*** | (2006.01) |
| ***F04B 27/00*** | (2006.01) |

(52) U.S. Cl.

CPC ..... *F04B 35/006* (2013.01); *F04B 27/005* (2013.01); *F04B 39/064* (2013.01)

(58) Field of Classification Search

CPC ..... F04B 35/006; F04B 27/005; F04B 39/064

See application file for complete search history.

(56) References Cited

U.S. PATENT DOCUMENTS 141,762 A * 8/1873 Chase ..... F04F 9/00 417/105

142,333 A * 9/1873 Gibbons ..... F04F 9/00 417/105

(Continued)

OTHER PUBLICATIONS

Zhu et al., U.S. Appl. No. 62/347,670, filed Jun. 9, 2016, titled "System and Method for Vacuum Generation".

(Continued)

*Primary Examiner* — Florian M Zeender
*Assistant Examiner* — Whitney Poffenbarger
(74) *Attorney, Agent, or Firm* — Lerner, David, Littenberg, Krumholz & Mentlik, LLP

(57) ABSTRACT

A vacuum generation system and method utilizes a dual-action piston-cylinder vacuum generation system to evacuate a vacuum storage. Saturated steam of higher than ambient pressure is inserted into a condensation cylinder with two chambers separated by a movable piston. Steam moves the piston to fill one chamber while expel gaseous content and condensate out of the other chamber. Steam is then condensed to a rough vacuum (RV) state by cooling. By repeated operations of inserting and condensing steam in each chamber alternatively, a sustained vacuum generation is achieved. A multi-level vacuum storage is also disclosed with a high vacuum (HV) storage placed inside a rough vacuum (RV) storage to reduce leakage as well as mechanical stresses. The vacuum generation system and method is extended for creating a prime mover or actuator to drive vacuum pumps maximizing thermal energy usage for increased vacuuming capacity.

18 Claims, 23 Drawing Sheets

Related U.S. Application Data

(60) Provisional application No. 62/347,670, filed on Jun. 9, 2016, provisional application No. 62/393,142, filed on Sep. 12, 2016, provisional application No. 62/396,313, filed on Sep. 19, 2016.

(56) References Cited

U.S. PATENT DOCUMENTS 1,405,821 A * 2/1922 Ehrhart ..... F01B 25/00 165/293
1,449,315 A * 3/1923 Christensen ..... F04B 35/00 417/105
2,171,698 A * 9/1939 Hetzer ..... G05D 16/12 137/210
2,343,464 A * 3/1944 Lienau ..... B01D 1/0082 159/44
3,703,809 A * 11/1972 Cassidy ..... F01K 19/04 60/645
4,319,964 A * 3/1982 Katz ..... C02F 1/16 202/172
4,536,257 A * 8/1985 Atwell ..... B01D 3/103 202/177
4,770,748 A * 9/1988 Cellini ..... B01D 1/30 159/31
5,441,606 A * 8/1995 Schlesinger ..... B01D 1/305 203/39
5,534,118 A * 7/1996 McCutchen ..... B01D 19/02 202/205
5,552,022 A * 9/1996 Wilson ..... B01D 3/103 202/176
5,968,312 A * 10/1999 Sephton ..... B01D 1/065 159/18
6,833,056 B1 * 12/2004 Kamiya ..... B01D 1/0052 202/155
8,967,173 B2 * 3/2015 Lin ..... B64F 5/60 137/1
9,309,129 B1 * 4/2016 Zeitoun ..... B01D 3/007
2005/0047935 A1 * 3/2005 Weiss ..... F04B 9/133 417/379
2006/0112694 A1 * 6/2006 Bishop ..... F01K 7/36 60/670
2008/0083605 A1 4/2008 Holtzapple et al.
2016/0288012 A1 10/2016 Zeitoun et al.
2016/0369750 A1 * 12/2016 Jung ..... F02M 25/03
2017/0356431 A1 12/2017 Zhu et al.

OTHER PUBLICATIONS

Zhu et al., U.S. Appl. No. 62/393,142, filed Sep. 12, 2016, titled "System and Method for Vacuum Generation".
He et al., "Dynamic Process Modeling on Depressurization by Cooling-Controlled Condensation in a Closed Chamber", International Journal of Heat and Mass Transfer, Mar. 7, 2014, vol. 78, pp. 330-340.

* cited by examiner

Variation 2

Variation 3

Variation 4

Step A2: Cold water into Cylinder Wall Channels to induce condensation of steam inside the cylinder (Chamber A)

The position of the piston is NOT changed during this step of operation

Step B1: Steam into Chamber B and move piston to push air out of Chamber A

SYSTEM AND METHOD FOR MULTI-LEVEL VACUUM GENERATION AND STORAGE

CROSS-REFERENCE TO RELATED APPLICATIONS

The present application is a continuation-in-part of pending U.S. patent application Ser. No. 15/617,612 filed on Jun. 8, 2017, which claims the benefit of the filing dates of U.S. Provisional Patent Application No. 62/347,670, filed Jun. 9, 2016, and U.S. Provisional Patent Application No. 62/393,142, filed Sep. 12, 2016, and U.S. Provisional Patent Application No. 62/396,313, filed Sep. 19, 2016, the disclosures of which are hereby incorporated herein by reference.

FIELD OF THE DISCLOSURE

The present disclosure relates to a vacuum generation and storage system. In particular, the present disclosure relates to a dual-action piston-cylinder, multi-level vacuum generation system by wall-imbedded cooling and/or atomized spray cooling, and a multi-level vacuum storage system.

BACKGROUND

Vacuum processing technology is used in a large number of general industrial applications. Current vacuum technology includes positive displacement pumps, momentum transfer pumps, entrapment pumps, and ejectors to generate sub-atmospheric pressure at different vacuum levels. Most of the current vacuum generation systems rely on electricity and/or compressor as prime power source for producing mechanical movements in the systems. Each type of pumping mechanism has different characteristics in terms of the size and shape of volume to fill. However, the current vacuum technology lacks scalability that is necessary for being used economically in large-scale systems, especially those involving open flows that require a continued or repeated vacuuming actions.

It is very costly to generate sufficient removal flowrate for systems such as vacuum membrane separation for desalination or ground based altitude chambers that simulate cabin or cargo depressurization and reduced-pressure tubes that transport pods carrying passengers in high-speed transportation systems. U.S. Pat. No. 8,967,173 B2 to Lin et al. (the '173 Patent) describes the use of condensation of steam for reducing pressure in an enclosed volume. Cost savings on energy consumption, and facility maintenance, are achieved since it is much easier to run a steam plant than to maintain a facility with large vacuum pumps. A significant issue, however, in the system and method disclosed in the '173 Patent is its dependence on the use of steam to flush gas, which has been previously extracted from a vacuum-needed application, out of the condensation chamber. During this process, newly inserted steam first mixes with gas present in the condensation chamber and is flushed out as a mixture. Another drawback of the system in the '173 Patent is premature condensation during the mixing of steam with gas. As a result, a significant portion of the steam inserted into the condensation chamber is lost and the condensation chamber is not completely filled with steam but a certain portion of non-condensable gas still remains. This amount of non-condensable gas residue can significantly affect the limit of vacuum achieved.

Vacuum storage and application spaces are all subject to permeation and leakage to some degree, which of course depend on the design of the storage, the quality of the materials, the precision of the work, and various other factors. The lower the pressure to be maintained in the storage, the higher the requirement to its tightness. This is because the expenditure for generating and maintaining vacuum increases drastically with decreasing pressure. In general, to attain or maintain the high vacuum level, the vacuum generator must be capable of continuously evacuating the leakage entering the system. The associated problems are the high leakages and resultant high energy and infrastructure costs.

As a result there is still a need in the art for a vacuum generation and storage system that overcomes the drawbacks of the current systems.

SUMMARY

The present invention solves the problems of current state of the art and provides many more benefits. In accordance with embodiments of the present disclosure, a system and a method are disclosed for reducing pressure to a nearly vacuum state, such as to a pressure level at a few percentages of the atmospheric pressure, in a vacuum storage. In one embodiment, a saturated steam of higher than atmospheric pressure should become available, such as generated from a low-pressure steam boiler where water is fed. A first quantity of steam is inserted into the first chamber of two chambers separated by a movable piston in an enclosed cylinder with wall-imbedded heat exchangers or similar heat transfer devices through the cylinder wall or ending plates. It is noted that, during this steam insertion process, there is little steam condensation due to the shut-off state of the wall-imbedded heat exchangers or similar heat transfer devices through the cylinder wall or ending plates. Thus, driven by the pressure difference between the inserted steam in the first chamber and gas in the second chamber, the first quantity of steam moves the piston to increase the volume of the first chamber, reduce the volume of the second chamber and expel gaseous content and condensates out of the second chamber. By the completion of this steam insertion, the piston is now at the end of the cylinder. Now the first chamber nearly occupies the entire cylinder with inserted steam, and the second chamber is of little space with gas and condensates completely expelled out of the cylinder. Now, shut-off both the steam inserting port of the first chamber and the vent port of the second chamber, and open valves to activate the wall-imbedded heat exchangers or similar heat transfer devices through the cylinder wall or ending plates.

The first quantity of steam is condensed to generate a depressurized or nearly vacuum state in the first chamber by the cooling of wall-imbedded heat exchangers and/or atomized spray cooling from cylinder ends. The piston remains at the end of the cylinder during this vacuum generation process due to the shut-off state of all valves to the second chamber. After the completion of steam condensation in the first chamber, shut-off the valves that control the cooling flow through the wall-imbedded heat exchangers or similar heat transfer devices through the cylinder wall or ending plates. Then, by opening a control valve at the end plate of first chamber, a first quantity of gas is extracted from the depressurization-needed application system into the first chamber. Upon the completion of vacuuming extraction, the extraction port is closed while the steam port on the end plate of second chamber is opened. A second quantity of steam is inserted into the second chamber in the enclosed cylinder. Thus, driven by the pressure difference between the inserted steam in the second chamber and extracted gas in the first chamber, the second quantity of steam moves the piston to increase the volume of the second chamber, reduce the volume of the first chamber and expel gaseous content and condensates out of the first chamber. By the completion of this steam insertion, the piston is now at the other end of the cylinder. Now the second chamber nearly occupies the entire cylinder with inserted steam, and the first chamber is of little space with gas and condensates completely expelled out of the cylinder. Now, shut-off both the steam inserting port of the second chamber and the vent port of the first chamber, and open valves to activate the wall-imbedded heat exchangers or similar heat transfer devices through the cylinder wall or ending plates.

The second quantity of steam is then condensed to generate a depressurized or nearly vacuum state in the second chamber by the cooling of wall-imbedded heat exchangers and/or atomized spray cooling from cylinder ends. The piston remains unmoved during the vacuum generation in the second chamber due to the shut-off state of all valves to the first chamber. After the completion of steam condensation in the second chamber, shut-off the valves that control the cooling flow through the wall-imbedded heat exchangers or similar heat transfer devices through the cylinder wall or ending plates. Then, by opening a control valve at the end plate of the second chamber, a second quantity of gas is extracted from the depressurization-needed application system into the second chamber. Upon the completion of vacuuming extraction in the second chamber, the extraction port is closed while the steam port on the end plate of the first chamber is opened to insert the steam into the first chamber. Thus, a complete cycle of dual-chamber vacuuming process is realized in the dual-action piston-cylinder system. These procedures above are repeated cyclically by inserting steam into a chamber while repelling previously-extracted gas from another chamber, followed by condensation-induced vacuum generation and further vacuuming extraction and so on.

The dual-chamber configuration in the dual-action piston-cylinder system combines filling steam in one chamber with expelling gas in the other chamber. The separation of two chambers by the piston prevents the steam loss while ensuring a complete steam filling in the cylinder before being subject to condensation, thereby providing significant cost saving on energy consumption due to more efficient use of steam. It should be pointed out that, should there be a minor leakage of steam over the piston, the higher pressure on the steam-filling side ensures that the leakage direction is from the steam filling chamber to gas expelling chamber, which basically eliminates the possibility of having non-condensable gas in the steam-filling chamber.

In another embodiment, a dual-action piston-cylinder vacuum generation system comprises a condensation cylinder with wall-imbedded heat exchangers such as channels along its wall, a piston with seal that forms two chambers of variable volumes inside the condensation cylinder, a three-position closed-center steam valve, a three-position closed-center gas valve, a cold water valve, a steam generator or steam resources, a water chiller as cold water supply, and an insulation layer outside the cylinder wall to prevent heat exchange with the environment. The three-position closed-center steam valve is operable to control the insert of steam into the first or second chamber, respectively, or stop the insert. A piston is operable, in a reciprocal direction, under the pressure of the steam, to increase the volume of one chamber with steam insert into this chamber and to reduce the volume of the other chamber with any gas and condensate expelled out of that chamber. A cold-water valve is operable to control the insert the cold water into the wall-imbedded heat exchanger such as wall-imbedded channels. The cooling duo to cold water through the wall-imbedded heat exchanger condenses the steam present in the steam-inserted chamber such that a vapor-to-liquid phase change reduces pressure in the condensation cylinder.

In an embodiment, a method for reducing pressure to a nearly vacuum state in a vacuum storage includes inserting a first quantity of steam into the first chamber and expelling the gas from the second chamber in the condensation cylinder. The method includes condensing the first quantity of the steam in the first chamber in the condensation cylinder by wall cooling and/or atomized spray cooling from cylinder ends, then extracting a first quantity of gas from a vacuum-needed application into the first chamber in the condensation cylinder while, optionally, preheating the cylinder wall such as by inserting hot water into the wall-imbedded channels. This wall preheating reduces a premature wall steam condensation in the next steam insert process, and hence provides a mean of further steam or energy saving. The method further includes the steps of performing a reciprocal operation of the two chambers, which is the second action of the cycle and inserting a second quantity of steam into the second chamber and expelling the gas from the first chamber in the condensation cylinder, condensing the second quantity of the steam in the second chamber in the condensation cylinder by wall cooling and/or atomized spray cooling from cylinder ends, and then extracting a second quantity of gas from the vacuum-needed application into the second chamber in the condensation cylinder while, optionally, preheating the cylinder wall such as by inserting hot water into the wall-imbedded channels.

The steam used in the process could be the waste steam, or produced with waste heat, from some processing industries or any other heating sources including solar or geothermal energy or produced in a low-pressure boiler. In this manner, embodiments of the present disclosure provide systems and methods of vacuum generation with the energy-saving, portability and scalability that are hard to achieve with the electricity powered vacuum pumps. The systems of the present disclosure can operate at low- or non-pressurized conditions and use low-grade thermal energies, hence much safer and more economically viable, compared to those pressurized or high-grade energy dependent vacuum technologies. The low-grade thermal energy here refers to those of low-pressure, low temperature and/or low chemical potentials so that possessing the low thermodynamic availability.

In one embodiment, atomized spray nozzles are provided to expedite the condensation process. The spray nozzles serve to cool the inside of the chambers. Alternatively, other suitable wall cooling devices could be employed.

The leakage rate in a vacuum storage is proportional to the pressure difference inside and outside of the vacuum storage. It is much more expensive to remove gas from a high-vacuum storage than from a rough-vacuum storage or application space. In accordance with embodiments of the present disclosure, a high vacuum (HV) storage is placed inside a rough vacuum (RV) storage to reduce the pressure difference across the HV storage walls. The resulting multi-level vacuum storage reduces the leakage entering the high vacuum storage and evacuates more leakage entering the rough vacuum storage, thereby reducing energy costs for attaining and maintaining the high vacuum level. In addition, the much reduced pressure difference between RV and HV storages leads to a great reduction in mechanical stresses over the HV storage and hence reduces the material requirement and cost of the HV storage.

In accordance with embodiments of the present disclosure, another system and method are disclosed to create a prime mover or actuator with a dual-action piston-cylinder vacuum generation system to drive vacuum pumps, instead of evacuating a vacuum storage directly. By use of the mechanical force or the pressure difference over the piston, the shaft rod drives externally-linked vacuum pumps that provide more vacuum capacity and/or higher vacuuming. After the first chamber of a dual-action piston-cylinder vacuum generation system is depressurized to a nearly vacuum state with the method disclosed above, a second quantity of steam is inserted into the second chamber. The pressure of the second quantity of steam, together with the rough vacuum in the first chamber, moves the piston and the rod connected to the piston in one direction. The rod then drives one or more vacuum pumps to evacuate gas from the HV and/or RV storages. At the end of the piston stroke, the condensate in the first chamber is expelled out of the chamber and is recycled. Then the second action of the cycle starts by condensing the second quantity of steam in the second chamber to generate a depressurized or rough vacuum state through the cooling of chamber wall by using wall-imbedded heat exchangers and/or through the atomized spray cooling from cylinder ends. The pressure of the steam, together with the rough vacuum in the second chamber, moves the piston and the rod connected to the piston in the other direction. The rod then moves the pistons of two or more vacuum pumps to evacuate gas from the HV and/or RV storages. At the end of the piston stroke, the condensate in the second chamber is expelled out of the chamber and is recycled. The above procedures are repeated by inserting and condensing steam alternatively in the two chambers of the condensation cylinder. The dual-chamber configuration in the dual-action piston-cylinder system combines the pressure of steam on one side of the piston with rough vacuum, produced through condensation, on the other side of the piston to produce actuation power. The condensation cylinder is now a RV actuator, instead of a RV generator, which can be used to drive other mechanical devices including HV pumps. One particular advantages of this arrangement is the separation of the operational environment of the dual-piston dual-action cylinder from the operational environment of the mechanical devices powered by the dual-piston dual-action cylinder. For instance, the working substance of the dual-piston dual-action cylinder is steam and its condensates, while the powered devices (such as HV pumps) can work under different pressure and temperature with other substances. Another particular advantage of this arrangement is the better use of the thermal energy of the steam for more useful work, which is realized by reducing the thermodynamic irreversibility in the piston motion process.

In this manner, embodiments of the present disclosure provide a design of a scalable, environmentally friendly, safer, waste-heat utilizable and low energy consumption system for rough and high vacuum generation and storage. The linear motion of the RV actuator may be converted through a gear mechanism into linear motion of other stroke length to drive liner pumps or into rotary motion to drive rotary pumps. Much reduced use of electricity and efficient use of steam provide significant cost saving on energy consumption in generating high vacuum, which also greatly improves the portability of the system.

In another embodiment, a dual-action piston-cylinder rough vacuum generation system comprises, in addition to the dual-action piston-cylinder vacuum generation system, a compression cylinder, a piston with seal that forms two chambers of variable volumes inside the compression cylinder, a three-position closed-center valve connected via pipe to the RV storage, and a three-position closed-center valve connected via pipe to ambient or a recycling facility. The three-position closed-center RV valve is operable to receive a first quantity of gas from the RV storage and insert it into the first chamber inside the compression cylinder. A piston is operable by the piston movement of the dual-action piston-cylinder vacuum generator to increase the volume of the first chamber and reduce the volume of the second chamber expelling gas present in the second chamber into the ambient or a recycling facility. The piston is then operable by the piston movement of the dual-action piston-cylinder vacuum generator to decrease the volume of the first chamber expelling gas present in the first chamber into the ambient or a recycling facility, and increase the volume of the second chamber receiving a second quantity of gas from the RV storage through the three-position closed-center RV valve. This dual-action cycle repeats to reduce the pressure in the RV storage.

In another embodiment, a dual-action piston-cylinder high vacuum generation system comprises a compression cylinder, a piston with seal that forms two chambers of variable volumes inside the compression cylinder, a three-position closed-center valve connected via pipe to the HV storage, and a three-position closed-center valve connected via pipe to the RV storage or ambient or a recycling facility. The three-position closed-center HV valve is operable to receive a first quantity of gas from the high vacuum storage and insert it into the first chamber inside the compression cylinder. A piston is operable by the piston movement of the dual-action piston-cylinder vacuum generator to increase the volume of the first chamber and reduce the volume of the second chamber expelling gas present in the second chamber into the RV storage through the three-position closed-center RV valve. The piston is then operable by the piston movement of the dual-action piston-cylinder vacuum generator to decrease the volume of the first chamber expelling gas present in the first chamber into the rough vacuum storage through the three-position closed-center RV valve, and increase the volume of the second chamber receiving a second quantity of gas from the HV storage through the three-position closed-center HV valve. This dual-action cycle repeats to reduce the pressure in the HV storage.

In another embodiment, a method for generating a vacuum with a dual-action piston cylinder vacuum generation system, comprising, completing at least one cycle of a vacuum generation operation with a dual-action piston cylinder vacuum generation system, wherein the one complete cycle includes: (a) switching a steam distribution valve to a side A of a cylinder to allow flow of steam from the steam distribution valve into a chamber A of the cylinder, wherein steam pressure pushes a piston to move towards an end of a side B of the cylinder, and piston movement increases volume of the chamber A and fills the chamber A with the steam, while simultaneously the piston movement decreases volume of chamber B, and compresses content of chamber B and increases pressure inside chamber B; and wherein when pressure inside the chamber B reaches an ambient pressure, an air and condensate exit valve is opened to allow air and condensate inside the chamber B to exit, and when the piston reaches to the end of side B, the air and condensate exit valve closes, and the chamber A is filled with the steam; (b) opening a cold water supply valve to allow flow of cold water into a plurality of cylinder wall channels to induce condensation of steam inside the chamber A; wherein a continued condensation of steam reduces pressure inside the chamber A into a vacuum state; and once a vacuum level in the chamber A reaches a predetermined level, the cold water supply valve is closed to stop flow of the cold water into the cylinder wall channels, and the chamber A is filled with a vacuum; (c) switching an air valve to the side A of the cylinder, and switching a steam/air switch valve to allow air flow from an application volume into the cylinder, thereby allowing air to now enter into chamber A of the cylinder and increase the pressure inside chamber A, wherein when pressure inside the chamber A reaches a predetermined level, both the air valve and the steam/air switch valve will close; and the chamber A is filled with the air; (d) switching the steam distribution valve to the side B of the cylinder and the steam/air switch valve to allow flow of steam from the steam distribution valve into the chamber A of the cylinder, wherein the steam pressure pushes the piston to move towards the end of the side A, and the piston movement increases the volume of chamber B and fills the chamber B with steam; and simultaneously the piston movement decreases the volume of chamber A, which compresses the chamber A content and increases the pressure inside chamber A; and when the pressure inside the chamber A reaches the ambient pressure, the air and condensate exit valve is opened to allow air and condensate inside the chamber A to exit; and when the piston reaches to the end of side A, the air and condensate exit valve closes, and the steam distribution valve and steam/air switch valve closes, and chamber B is filled with steam; (e) opening the cold water supply valve to allow flow of the cold water into the cylinder wall channels to induce condensation of steam inside the chamber B, wherein the continued condensation of steam reduces pressure inside the chamber into a vacuum state; and once the predetermined vacuum level is reached, the cold water supply valve is closed to stop flow of cold water into the cylinder wall channels; and the chamber B is vacuum filled; and (f) switching the air valve to the side B of the cylinder, and switching the steam/air switch valve to allow flow of air from the application volume into the cylinder; wherein air is now entering into the chamber B of the cylinder and increases the pressure inside chamber B, and when pressure inside the chamber B reaches the predetermined level, both the air valve and the steam/air switch valve closes; and chamber B is filled with air; and removing steps (c), (d) and (f), when similar vacuum generation operation is used to create a prime mover or an actuator due to the vacuum in the cylinder is no longer used to evacuate the application directly.

Embodiments of the present disclosure are related to generate a low pressure environment, from sub-atmospheric pressure to near-vacuum, in enclosed large-scale volumes or open-flow systems. More particularly, embodiments of the present disclosure are related to evacuating gas and vapor in vacuum-assisted applications such as wastewater treatments, sea water desalination, petroleum refining, vapor deposition, vacuum cleaning, aerosol filtration, and vacuum-assisted pneumatic conveying. Embodiments of the present disclosure are also related to ground based altitude chambers that simulate cabin or cargo depressurization, and reduced-pressure tubes that transport pods carrying passengers in high-speed transportation systems.

Any combination and/or permutation of the embodiments are envisioned. This summary is not intended to identify key or essential features of the claimed subject matter, nor is it intended to be used as aid in determining the scope of the claimed subject matter. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

A more complete understanding of embodiments of the present disclosure may be derived by referring to the detailed description and claims when considered in conjunction with the following figures. The figures are provided to facilitate understanding of the disclosure without limiting the breadth, scope, scale, or applicability of the disclosure. The drawings are not necessarily made to scale.

DETAILED DESCRIPTION

Figure 1:
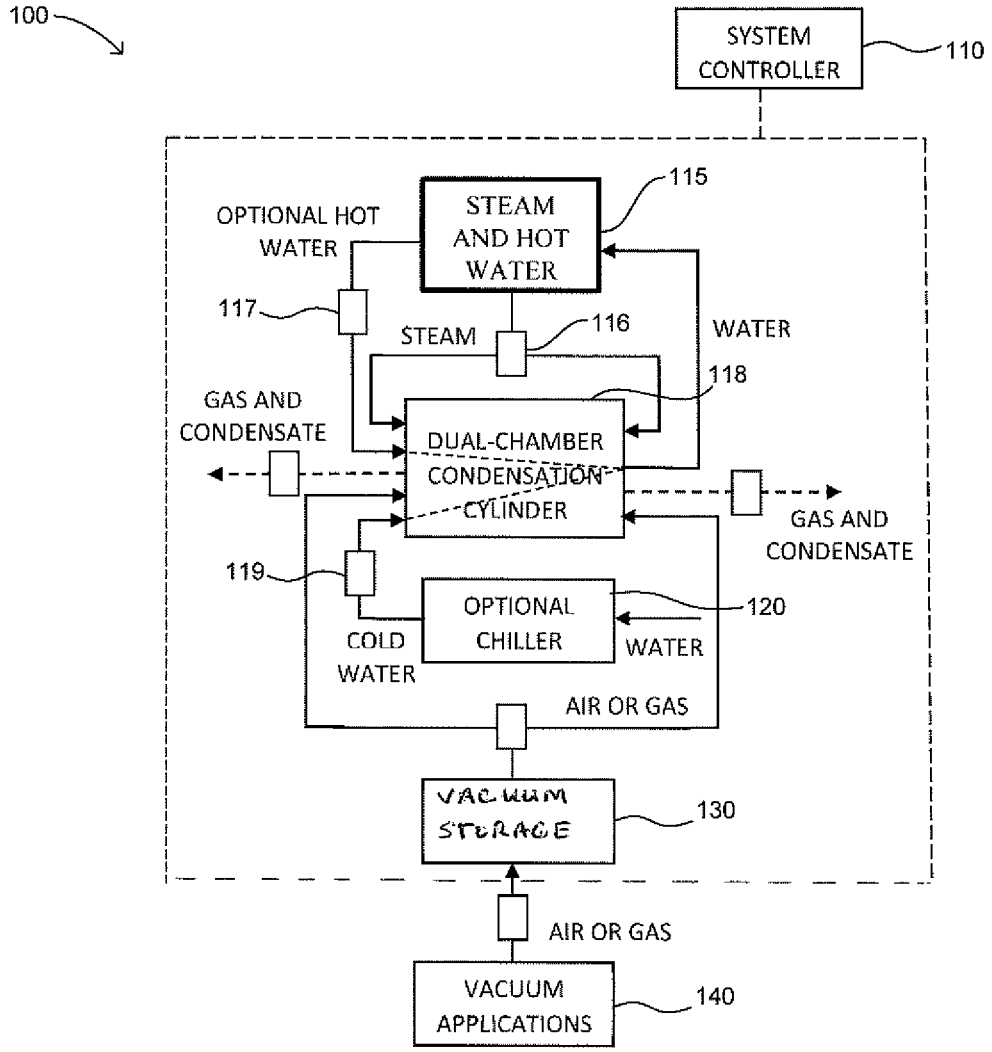
FIG. 1 is an illustration of an exemplary functional block diagram of a dual-action piston-cylinder rough vacuum (RV) generation system and a vacuum application, according to an embodiment of the present disclosure.

The following detailed description is exemplary in nature and is not intended to limit the present disclosure or the application and uses of the embodiments of the present disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to vacuum generation techniques, steam plants, pressure regulators, ducting systems, control systems, and other functional aspects of the systems (and the individual operating components of the systems) may not be described in detail herein. In addition, those skilled in the art will appreciate that embodiments of the present disclosure may be practiced in conjunction with a variety of structural bodies, and that the embodiments described herein are merely example embodiments of the present disclosure.

Depending on the embodiment, the steam entering one chamber should be saturated at a pressure 10-20% higher than the ambient pressure, in order to move the piston and push gas out of the other chamber during the steam filling. The steam temperature is at the corresponding saturation temperature. While higher pressure may be used for the steam, more cooling will be required to condense the steam in the subsequent step. The temperature of the cooling water should be as low as practically possible and chilled if necessary. This temperature affects both the level of the vacuum produced inside the cylinder and the cooling time needed to reach the vacuum level.

Embodiments of the present disclosure are described herein in the context of practical non-limiting application, namely, a rough vacuum generation system, and a multi-level vacuum generation system powered with a rough vacuum generation and actuation system. Embodiments of the disclosure and the techniques described herein, however, may be utilized in various vacuum applications 140. For example, but without limitation, embodiments may be applicable to a vacuum-assisted device for wastewater treatments, sea water desalination, petroleum refining, vapor deposition, vacuum cleaning, aerosol filtration, vacuum-assisted pneumatic conveying, a ground based altitude chamber for aircraft cabin or cargo depressurization simulation, and reduced-pressure tubes that transport pods carrying passengers in high-speed transportation systems.

One application involves wastewater treatment technology. Industrial wastewater from chemicals industry, electric power plants, nuclear industry, agricultural and food operations, iron and steel industry, and hydraulic fracturing, etc. must be treated to reduce their damage to the environment. Vacuum evaporation and distillation can lead to a dramatic reduction in the volume of liquid waste to make it easier to treat effluents.

Another application involves desalination technology. More than one in every six people in the world does not have access to potable water. Two converging phenomena drive water scarcity: growing freshwater use and depletion of usable freshwater resources. Desalination of sea water is already common in arid areas of the world. Vacuum Membrane Distillation (VMD) is becoming a viable process for desalination.

Another application involves high-volume aerosol filtration technology. A high efficient aerosol filtration system, such as High-Efficiency Particulate Arrestance (HEPA) filter for removal of ultrafine particulates such as PM2.5 (particulate matter less than 2.5 micrometers in diameter), typically requires a high pressure head to overcome the high pressure drop that increases in a quadratic function with the increase in flowrate. This disclosed vacuum technology provides an ideal flow driving solution, which is of low energy cost and low noise, while generating high pressure difference to meet the ever-growing needs of filtrations of ultrafine aerosols.

Another application involves high-speed transportation systems (hyperloop). A conceptual high-speed transportation system incorporates reduced-pressure tubes in which pressurized capsules ride on an air cushion driven by linear induction motors and air compressors. Preliminary analysis indicates that such a route may obtain an average speed of around 600 mph (970 km/h), with a top speed of 760 mph (1,200 km/h). Such systems will rely on efficient and continuous vacuum generation as a critical component due to its incorporation of reduced-pressure tubes.

As would be apparent to one of ordinary skill in the art after reading this description, the following are examples and embodiments of the present disclosure and are not limited to operating in accordance with these examples. Other embodiments may be utilized and structural changes may be made without departing from the scope of the exemplary embodiments of the present disclosure.

Existing systems for vacuum processing technology typically are noisy due to a mechanism used to extract gas from a vacuum-needed application. Also it is very costly to apply these existing systems to very large enclosed volumes due to the energy consumption for such a facility.

Embodiments of the disclosure solve this problem by generating rough vacuum by condensing steam with a more efficient system and method, and then by actuating vacuum pumps with power from the pressure of the rough vacuum and steam. For an even wider application, the system and method described herein can be used in high-speed transportation system development around the world, such as the high speed rails or the use of reduced-pressure tubes that transport pods carrying passengers in a hyperloop. Therefore, testing and/or operating at high speed in an enclosed tunnel or tube under lower pressure is necessary to reduce drag and noise and would enable more efficient operation. Embodiments of the disclosure provide viable means for depressurizing an enclosed tunnel or tube with low energy consumption.

Embodiments of the disclosure apply phase change to produce depressurization to a rough vacuum state in a vacuum storage 130. Embodiments of the disclosure also apply the rough vacuum and steam as efficient actuation power for driving vacuum pumps. Furthermore, embodiments of the disclosure apply multi-level vacuum storage to reduce the energy costs for attaining and maintaining the vacuum level in application.

FIG. 1 is an illustration of an exemplary functional block diagram of a dual-action piston-cylinder rough vacuum generation system 100 according to an embodiment of the present disclosure. The system 100 could include a steam generator, a plurality of condensation piston-cylinders of sufficient thermal conduction comprising channels in the cylinder walls and/or a plurality of atomizing spray nozzles, a piston of sufficient thermal insulation coupled with a seal in each of the condensation piston-cylinders, a three-position closed-center steam valve (or a pair of two-way steam valves), a plurality of compression piston-cylinders, and a system controller 110 that operates the valves through its interactions with two sets of position, pressure and temperature sensors installed on each of the condensation piston-cylinder. It will be understood that the number of piston-cylinders could vary. An optional water chiller 120 could be used to ensure that the temperature of the cold water for inducing condensation is sufficiently low for the desired vacuum level. When the dual-action piston-cylinder rough vacuum generation system is to be used as a prime mover or actuator, hot water could be supplied from the steam generator to prevent any potential premature condensation of steam by repelling cold water from cooling channels and heating the piston-cylinders before and during steam-filling.

The rough vacuum generation system could include subsystems and components to measure and control process variables, such as pressure and temperature, as required for effective performance. The controller 110 could receive at least one process parameter, process at least one process parameter, and adjust operation of the system based upon processing of at least one process parameter.

In the first action, a steam valve 116 is opened to allow the first quantity of steam, typically at an elevated pressure above atmospheric pressure, to flow into one of the two chambers in each of a plurality of condensation cylinders 118. The condensation cylinders 118 could include, for example, condensation cylinders 1 to N, where N is an integer. The number N can be any number greater than or equal to one. The number N may be chosen based on, for example, but without limitation, a flow rate control, a condensation cylinder cost, and an energy use (e.g., few large cylinders may use less energy). The controller 110 detects the completion of the steam filling, based on the position of the piston, or the pressure and the temperature in the first chambers, and moves the steam valve accordingly to the off position to stop the flow of the first quantity of the steam.

A cold water valve 119 opens to allow the first quantity of the cold water into wall channels of the condensation cylinders and expel any water present in the channels, and/or into the chamber through atomizing spray nozzles. The first quantity of cold water reduces a temperature in the condensation cylinders and condensates the saturated steam into water. For example, but without limitation, the temperature on the condensation surface could be reduced from about 105° C. to about 15° C. In this example, the steam condensation into water reduces the pressure inside the first chambers in the condensation cylinders to a rough vacuum state, such as at a pressure of 1.7 kPa or less than 2% of the atmospheric pressure.

The controller 110 detects the lower pressure in the first chambers and moves a three-position gas valve 122 accordingly to the first position to allow the first quantity of the gas to flow to the first chambers, thereby depressurizing the target vacuum-needed application system to a desired vacuum level or sub-atmospheric pressure.

The controller 110 detects the proper cylinder pressure for the completion of the drawing gas from the vacuum-needed application and moves the three-position gas valve 122 to the off position accordingly to stop the flow of the first quantity of gas into the first chambers.

The controller 110 moves the steam valve 116 accordingly to the second position to allow the second quantity of the steam to flow into the second chambers in each of the condensation cylinders. The pressure of the steam fills the second chambers and moves the pistons and expels the gas previously flowed into the first chambers and any condensates in the first chambers.

The controller detects the completion of the steam filling and moves the steam valve to the off position to stop the flow of the second quantity of the steam. The cold water valve 119 opens again to allow the cold water into the wall channels, and/or into the chamber through the atomizing spray nuzzles, of the condensation cylinders to reduce a temperature in the condensation cylinders by condensing the saturated steam into water. Changing the steam to water reduces a pressure inside the second chambers in the condensation cylinders to a pressure lower than that in the vacuum-needed application 140 such that the gas can flow into the second chambers.

The controller 110 detects the pressure below a designed value in the second chambers and moves three-position gas valve 122 accordingly to the second position to allow the gas to flow into the second chambers, thereby depressurizing the target vacuum-needed application system to a desired vacuum level or sub-atmospheric pressure.

During operation, all the water flowing through the wall channels of the cylinders when heating or cooling the cylinders is recycled to a steam and hot water generator 115.

A single cylinder system does not provide continuous vacuum operations, due to the short transition time needed to depressurize the chamber during the two actions. Additional identical cylinders should be used if a continuous vacuum operation is desired. For dual-cylinder or multiple-cylinder systems, properly arranged delay in starting the operation of each cylinder is required to ensure at least one cylinder is ready to provide vacuum at any time. Alternatively, a vacuum-buffer chamber, such as a vacuum storage or a rough vacuum enclosed volume 130, can be used to sustain a continued vacuum suction operation.

Figure 2:
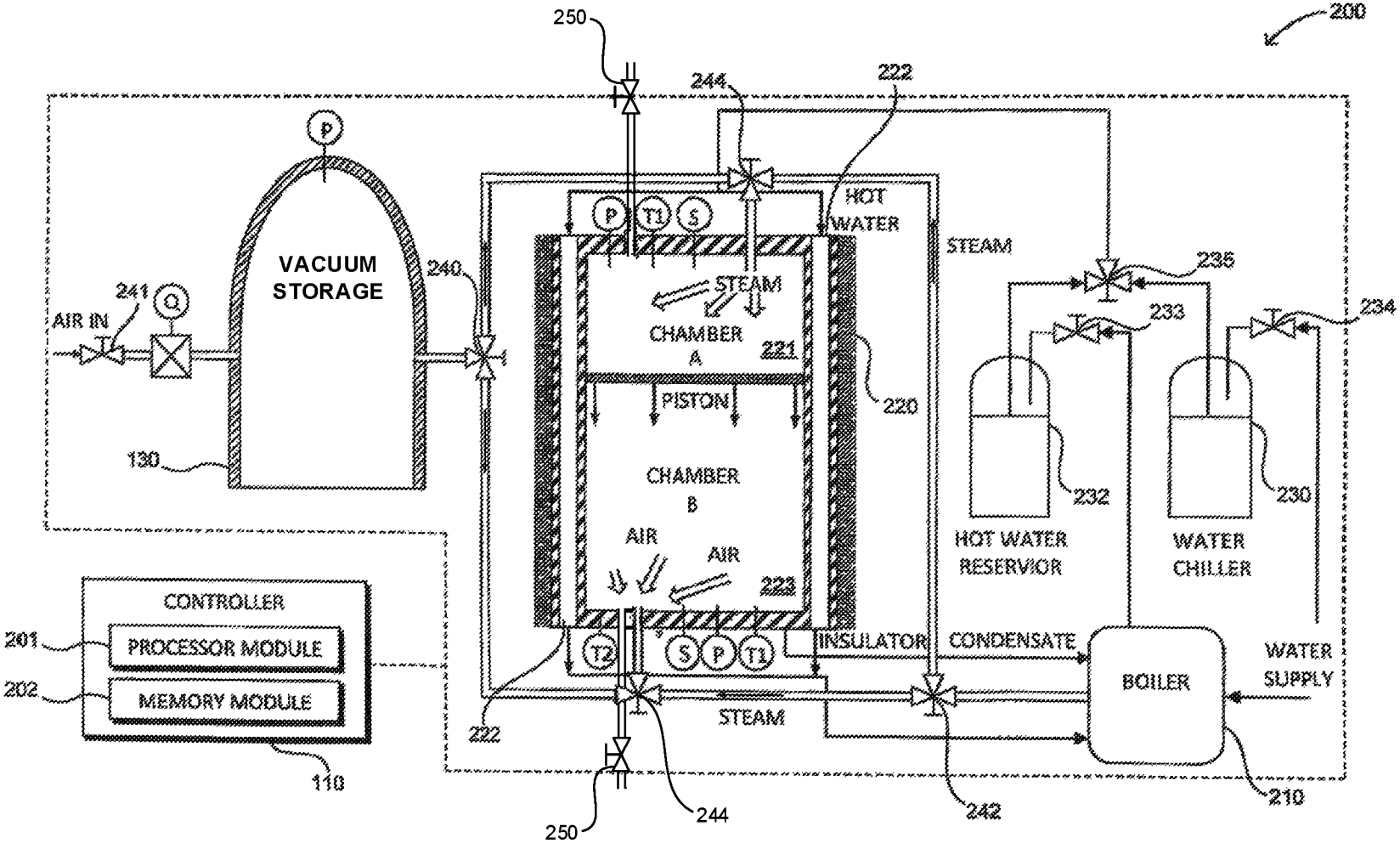
FIG. 2 is an illustration of an exemplary simulation of dual-action piston-cylinder vacuum generation system in FIG. 1, illustrated by the process of steam filling into chamber A while expelling air out of chamber B.

FIG. 2 is an illustration of an exemplary dual-action piston-cylinder vacuum generation system 200 in more detail according to an embodiment of the disclosure. The system could comprise the vacuum storage or rough vacuum enclosed volume 130, a boiler 210 for steam and hot water generation, a plurality of condensation piston-cylinders 220 comprising channels 222 in the cylinder walls, a water chiller 230 for cold water, a hot water reservoir 232, a three-position closed-center gas valve 240, a three-position closed-center steam valve 242, two gas valves 244, two air/condensate exit valves 250, and a controller 110 that operates the valves through its interactions with two sets of position sensor S, pressure sensor P and temperature sensors T1 and T2 installed on each of the condensation piston-cylinders, and temperature sensor T embedded in the cylinder wall close to the condensation surface. The configuration of the dual-action piston-cylinder illustrated in FIG. 2 is the variation 1 among several other conceivable variations exemplified in FIG. 4.

The vacuum storage 130, functioned as a vacuum storage, is coupled to the three-position closed-center gas valve 240. The vacuum storage 130 draws the gas from the application which utilizes the vacuum or extremely-low sub-atmospheric pressure of the enclosed volume when valve 241 coupled to the application is opened. The gas is then extracted from the vacuum storage 130 or enclosed volume through the three-position closed-center gas valve to provide a reduced pressure in the enclosed volume. The gas then flows alternately through respective gas ducts to the respective chambers when the three-position closed-center gas valve is in its first and second position respectively.

The three-position closed-center gas valve between the vacuum storage and the chambers of the condensation cylinders opens to the respective gas ducts to allow the gas in the enclosed volume to be drawn alternately into the two chambers 221 and 223 in each of the condensation cylinders 220 respectively based on respective pressure in the chambers of the condensation cylinders.

In this manner, the three-position closed-center steam valve moves to the first position to allow a first steam flow of a first quantity of the steam into the first chambers 221 of the condensation cylinders, moves to the second position to allow a second steam flow of a second quantity of the steam into the second chambers 223 of the condensation cylinders, and moves to a center position to block a first or second steam flow into the two chambers of the condensation cylinders.

Each of the two chambers is operable to receive the steam from the boiler 210 and extract the gas from the enclosed volume or the vacuum storage 130 alternately. In operation, the first chamber could begin to be filled with the steam and increase in volume, while the second chamber reduces its volume and expels any gas present though an outlet. The first chamber 221 begins to condense the first quantity of the steam and extracts the first quantity of the gas from the enclosed volume into the first chamber. Once the first chamber is filled with the first quantity of the gas, the three-position closed-center gas valve 240 moves to the center position to stop the flow of the first quantity of the gas from the enclosed volume into the first chamber. The second chamber 223 is filled by the second quantity of the steam, condenses the second quantity of steam, and begins to receive the second quantity of the gas. In this manner, the flow of the gas is alternated between the two chambers until a desired depressurization is obtained in the enclosed volume.

Water condensate and gas could exit from an outlet 250 in each chamber respectively. For example, the first quantity of the gas from the first chamber is substantially expelled during the flow of the second quantity of the steam.

The cold water is operable to condense the steam such that a vapor-to-liquid phase change reduces a pressure in the two chambers of condensation cylinders. The embodiment in FIG. 2 shows one condensation cylinder, but any number of additional condensation cylinders could be used to obtain the required vacuuming in the enclosed volume. The steam and hot water generator generates the steam at temperatures such as, for example, but without limitation, about 105° C. The steam and hot water generator also generates hot water at, for example, close to 100° C.

The steam inside the cylinder is then cooled down by the cold water. The water chiller provides the cold water through a duct to the wall channels in each of the cylinders. The cold water could come from a regular water supply or through a chiller at a temperature such as, for example, but without limitation, about 15° C.

The controller 110 comprises a processor module 201, a memory module 202, and connection wires to all the sensors and valve actuators. The controller is operable to control the three-position closed-center gas valve 240 between the vacuum storage and the two chambers to allow the gas in the vacuum storage be drawn to the chambers alternately. The controller is operable to control the three-position closed-center steam valve 242 between the steam generator and the two chambers to allow the steam to enter the chambers alternately. The controller is operable to control a hot water valve 233 and a cold water valve 234 and/or a three way valve 235 to allow the hot or cold water to flow into the wall channels of the cylinders to heat or cool the cylinders alternately. The controller is operable to control outlet valves 250 to allow gas and water condensate to exit the chambers during steam fillings.

The processor module comprises processing logic that is configured to carry out the functions, techniques, and processing tasks associated with the operation of the systems. In particular, the processing logic is configured to support the systems described herein. For example, the processor module could direct the three-position closed-center steam valve 242 to alternate the flow of the steam from the steam generator to the chambers. For another example the processor module could direct the three-position closed-center gas valve 240 to alternate the flow of the gas into the two chambers based on their pressures.

The processor module could be implemented, or realized, with a general purpose processor, a content addressable memory, a digital signal processor, an application specific integrated circuit, a field programmable gate array, any suitable programmable logic devices, discrete gates or transistor logic, discrete hardware components, or any combination thereof, designed to perform the functions described herein. In this manner, a processor may be realized as a microprocessor, a controller, a microcontroller, a state machine, or the like. A processor may also be implemented as a combination of computing devices, e.g., a combination of a digital signal processor and a microprocessor, a plurality of microprocessors, one or more microprocessors in conjunction with a digital signal processor core, or any other such configuration.

The memory module could comprise a data storage area with memory formatted to support the operation of the systems. The memory module is configured to store, maintain, and provide data as needed to support the functionality of the system. For example, the memory module could store a database, a temperature database, an operational control data, and flight configuration data.

In practical embodiments, the memory module could comprise, for example, but without limitation, a non-volatile storage device (non-volatile semiconductor memory, hard disk device, optical disk device), a random access storage device (for example, SRAM, DRAM), or any other form of storage medium known in the art.

The memory module could be coupled to the processor module and configured to store, for example, but without limitation, a pressure database, a temperature database, and an operational control data. Additionally, the memory module may represent a dynamically updating database containing a table for updating the database, and the like. The memory module could also store, a computer program that is executed by the processor module, an operating system, an application program, tentative data used in executing a program, and the like. The memory module could be coupled to the processor module such that the processor module can read information from and write information to the memory module.

As an example, the processor module and memory module could reside in respective application specific integrated circuits (ASICs). The memory module could also be integrated into the processor module. In an embodiment, the memory module could comprise a cache memory for storing temporary variables or other intermediate information during execution of instructions to be executed by the processor module.

Figure 3A:
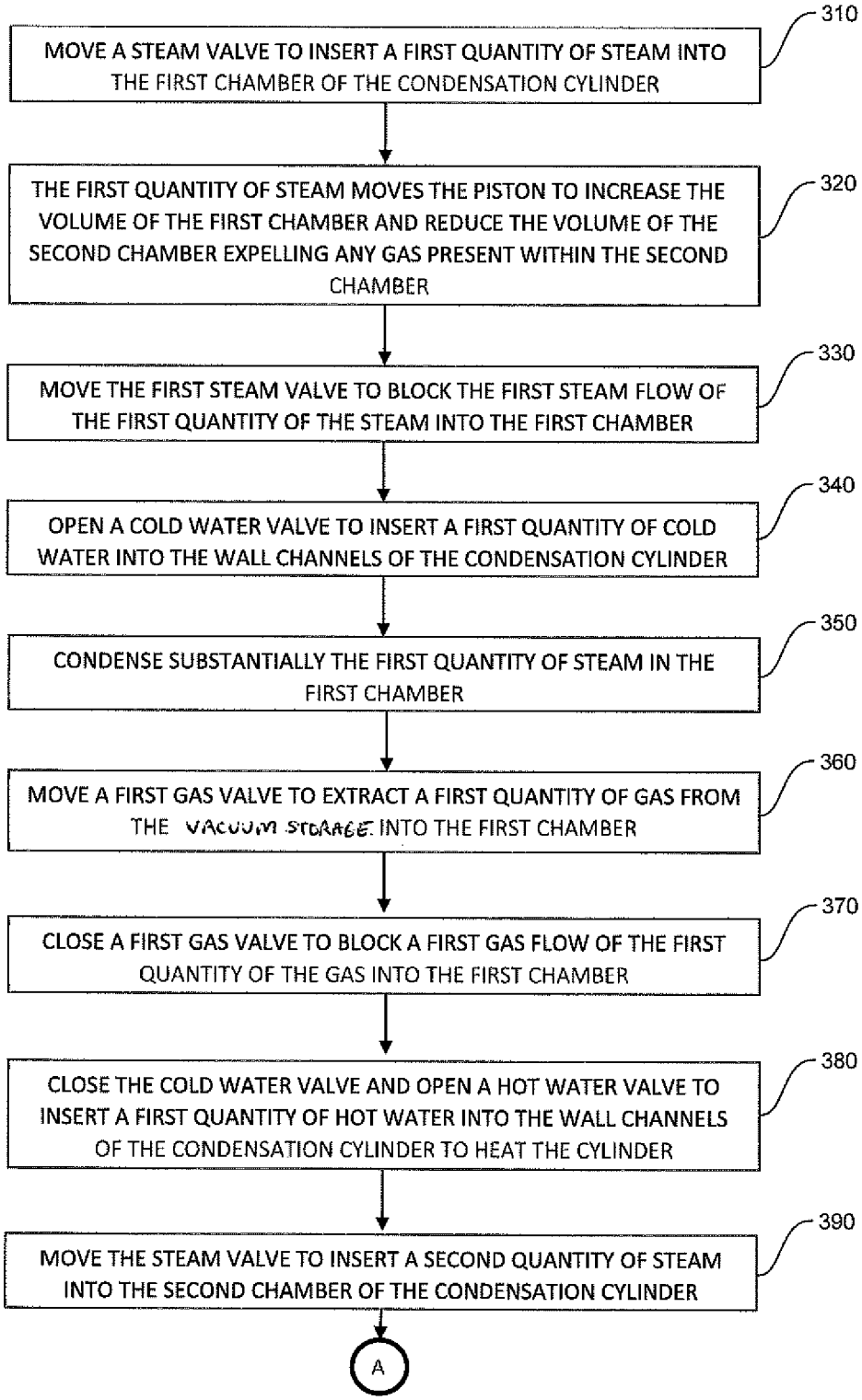
FIGS. 3A-3B are block diagrams illustrating an exemplary flowchart showing a dual-action cycle for a vacuum generation process.
Figure 3B:
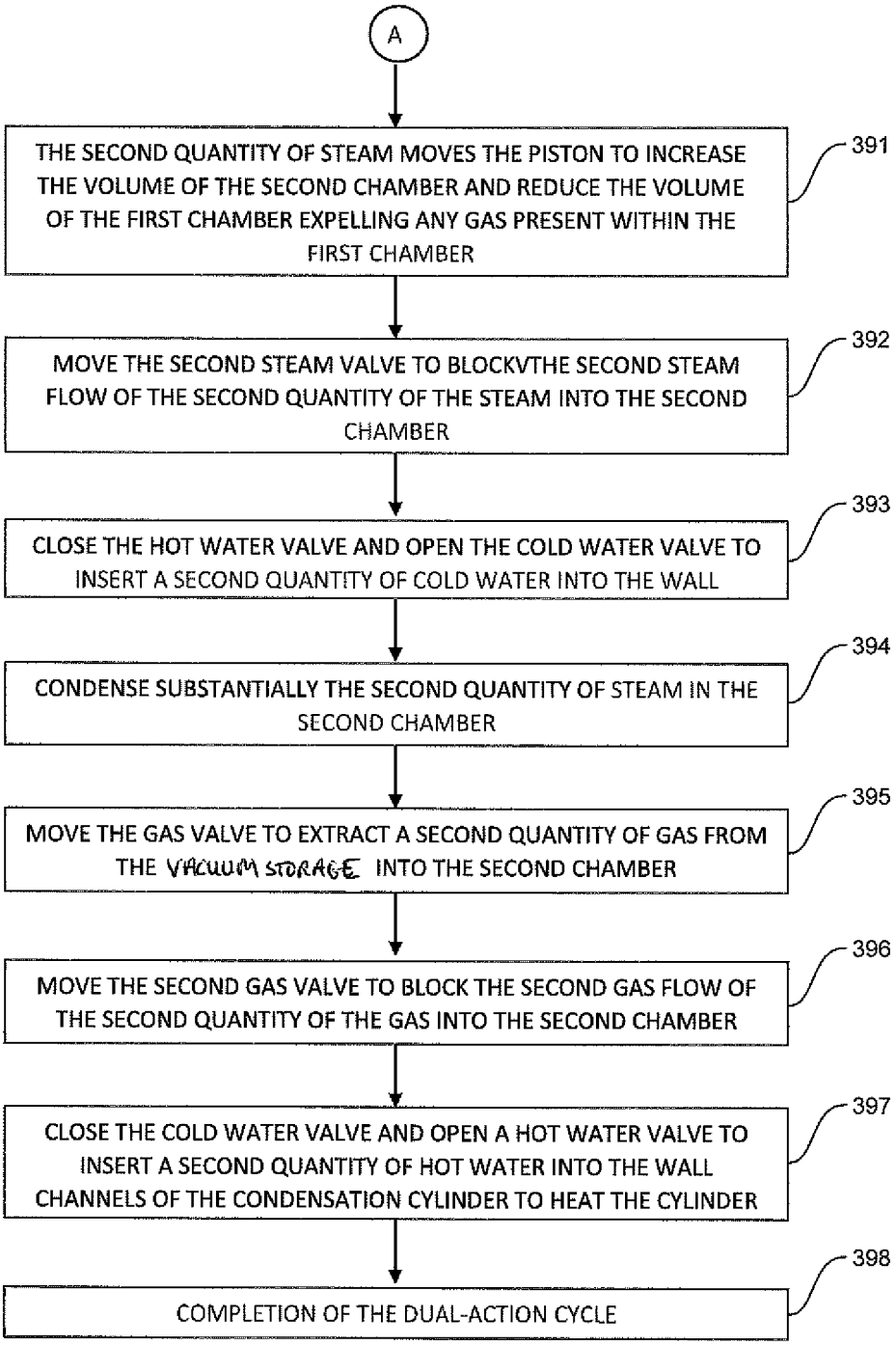

FIG. 3 is an illustration of an exemplary flowchart showing a vacuum generation process according to an embodiment of the disclosure. The various tasks performed in connection with the process could be performed mechanically, by software, hardware, firmware, a computer-readable medium having computer executable instructions for performing the processes methods, or any combination thereof. The tasks in the flowchart include an optional use of hot water 117 for pre-heating the cylinder during steam-filling. It should be appreciated that the process could include any number of additional or alternative tasks, the tasks shown in FIG. 3 need not be performed in the illustrated order, and the process could be incorporated into a more comprehensive procedure or process having additional functionality not described in detail herein. For illustrative purposes, the following description of the process could refer to elements mentioned above in connection with FIGS. 1 and 2.

In practical embodiments, portions of the process could be performed by different elements of the systems such as: the vacuum storage, the steam and hot water generator, the two chambers in the condensation cylinder, the coolant supply or chiller, the three-position closed-center gas valve, the three-position closed-center steam valve, and the like. The process could have functions, material, and structures that are similar to the embodiments shown in FIGS. 1 and 2. Therefore, common features, functions, and elements may not be redundantly described here.

Depending on the implementation, the process begins as shown in block 310 with a first action by inserting a first quantity of the steam into the first chamber (task 1).

The process continues as shown in block 320 by moving the piston inside the condensation cylinder to increase the volume of the first chamber and expelling the gas and water condensate from the second chamber (task 2).

Block 330 shows the process may continue by blocking the steam flow into the first chamber while holding the piston in place by closing the gas/condensate exit valve (task 3).

Next block 340 shows the process could continue by opening the cold water valve to cool the cylinder walls (task 4).

Block 350 shows the process could continue by condensing substantially the first quantity of the steam in the first chamber (task 5). The first quantity of the steam could be cooled, for example, but without limitation, from about 105° C. to about 15° C. Based on energy balance, a total enthalpy difference of the saturated steam at about 105° C. to the saturated water at about 15° C. can be obtained to determine an amount of the heat that needs to be removed. Accordingly the pressure in the first chamber is reduced from about 120 kPa to about 1.7 kPa.

Block 360 shows the process could then continue by moving the gas valve and extracting a first quantity of the gas from a rough vacuum storage or a vacuum-needed application into the first chamber (task 6).

Block 370 shows the process could continue by blocking the gas flow into the first chamber (task 7).

Block 380 shows the process could then continue by closing the cold water valve and, optionally, opening the hot water valve to heat the cylinder walls (task 8). The first action completes and the second action begins in the next task.

Block 390 shows the process could then continue by inserting a second quantity of the steam into the second chamber (task 9).

Block 391 shows the process could then continue by moving the piston inside the condensation cylinder to increase the volume of the second chamber and expelling the gas and water condensate from the first chamber (task 10).

Block 392 shows the process could then continue by blocking the steam flow into the second chamber while holding the piston in place by closing the gas/condensate exit valve (task 11).

Block 393 shows the process could then continue by closing the hot water valve, if hot water valve is opened when performing task 8, and opening the cold water valve to cool the cylinder walls (task 12).

Block 394 shows the process could then continue by condensing substantially the second quantity of the steam in the second chamber (task 13).

Block 395 shows the process could then continue by moving the gas valve and extracting a second quantity of the gas from a rough vacuum storage or a vacuum-needed application into the second chamber (task 14).

Block 396 shows the process could then continue by blocking the gas flow into the second chamber (task 15).

Block 397 The process could then continue by closing the cold water valve and, optionally, opening the hot water valve to heat the cylinder walls (task 16). As the second action completes, the cycle of dual-action completes as shown in the completion at Block 398.

Figures 4A, 4B, 4C:
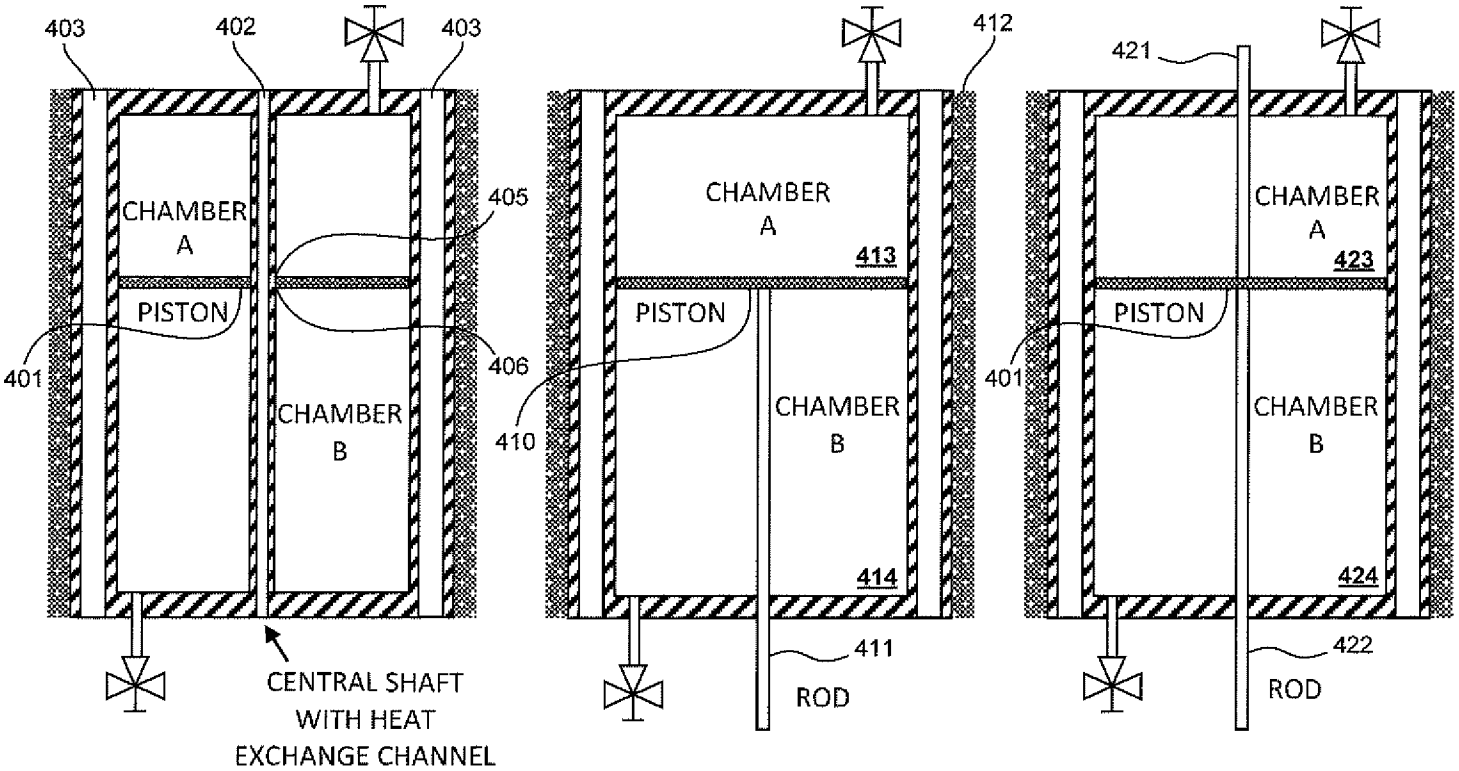
FIGS. 4A, 4B, and 4C are illustrations of exemplary variations of piston-cylinder configurations according to the present disclosure.

FIGS. 4A, 4B, and 4C are illustrations of exemplary additional variations of the embodiments of piston-cylinder configurations, with the embodiment in FIG. 2 as the first variation. The first variation uses a rodless piston whose movement inside the cylinder is caused by the pressurized steam (steam at elevated temperature), without any mechanical interactions with external mechanisms.

The second variation shown in FIG. 4A also uses a rodless piston 401, but one (or more) hollow shaft 402 is added to the inside of the cylinder along its axis. When only one shaft is used in this embodiment, however more may be disposed about the axis depending on the implementation. The shaft is to be placed at the center of the cylinder as shown in FIG. 4A. This hollow shaft provides additional structural support and guide for the piston and is to be used together with the channels 403 in the cylinder wall for additional heating and cooling the cylinder. The rodless piston in this variation has a central hole 405 and an accompanied seal 406 for moving along the central shaft 402.

The third variation as shown in FIG. 4B uses a piston 410 with a rod 411 attached to one side. As in the first variation, the pressurized steam is used to move the piston 410 inside the cylinder 412. With this variation, the piston rod 411 is used to interact with external mechanism when a dual-action piston-cylinder system is used as a prime mover or actuator. Due to the non-symmetric configuration, the two chambers (A&B) 413 and 414 respectively have slightly different volumes and operation parameters for the two chambers need to be adjusted accordingly.

The fourth variation shown in FIG. 4C uses a piston 420 with rods 421, 422 attached to both sides. The fourth variation works in the same way as the third variation, but with support at both ends, both the thickness of the piston and diameter of rods can be reduced to increase the volume in both chambers 423, 424 for the same cylinder. This variation provides a symmetric configuration such as the same operation parameters could be used for both chambers.

Variations 3 and 4 transfer some thermodynamic energy, generated by condensation-induced vacuum, back into mechanical work that otherwise may be lost during the simple vacuum suction such as in Variations 1 and 2. Variations 1 and 2 represent the no-load applications of the piston, while load is applied to piston in variations 3 and 4. Higher tightness of the seals is needed for variations 3 and 4, compared with the no-load configuration. While the tighter seal adds friction to the piston, variations 3 and 4 could still provide much better vacuuming capacities than those from variations 1 and 2.

Figures 5A, 5B, 5C:
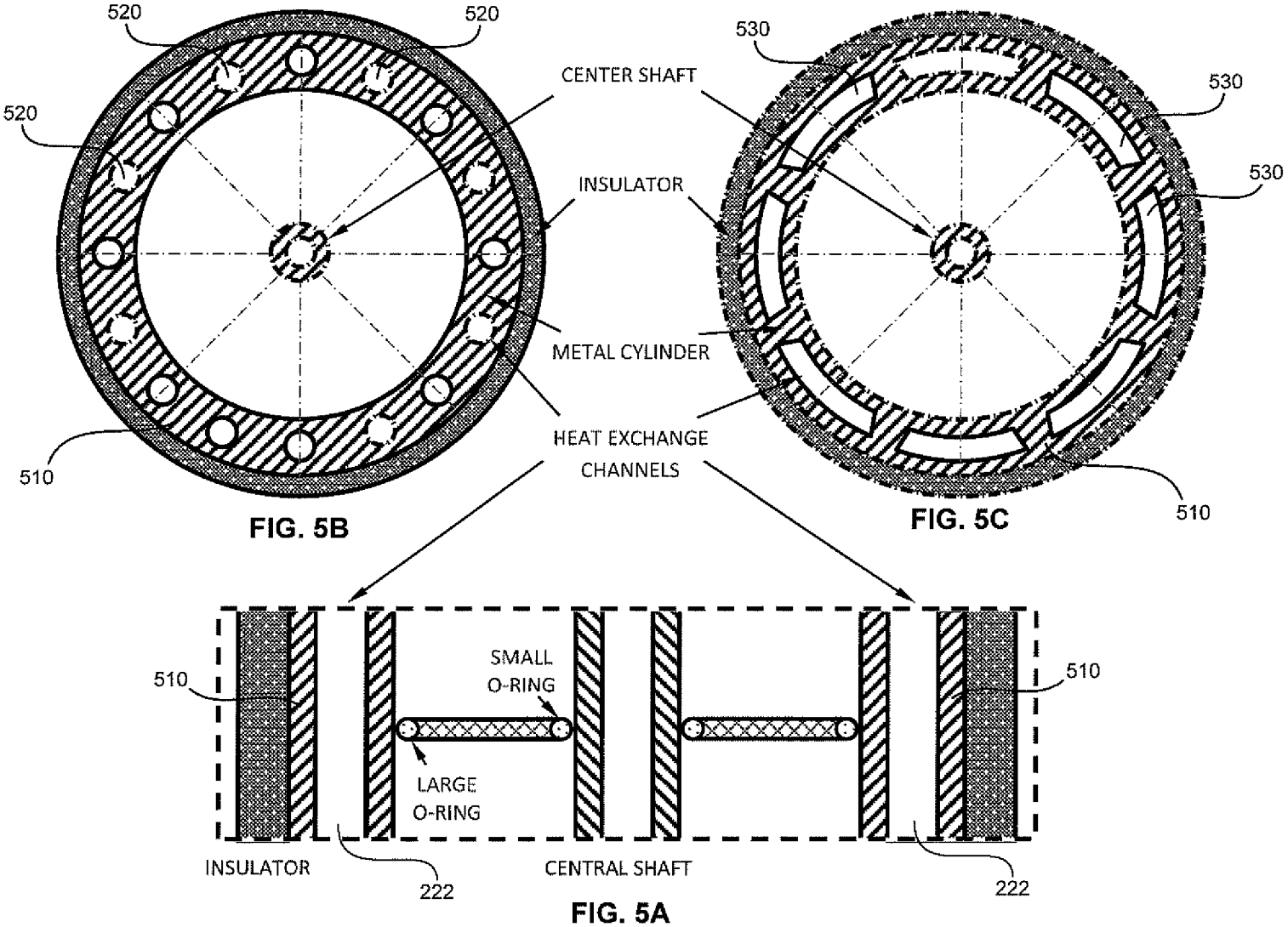
FIGS. 5A, 5B, 5C are an illustration of an exemplary cross-section view of the second variation of a piston-cylinder shown in FIG. 4A, and an illustration of two exemplary shapes of heat exchange channels in the cylinder wall.

FIGS. 5A, 5B, 5C are an illustration of an exemplary cross-section view of the second variation of the piston-cylinder. FIGS. 5B, 5C also provides an illustration of two exemplary channel shapes 520, 530 respectively in the cylinder wall 510. It will be understood that other channel shapes could be employed for better mechanical structure, material saving, and/or energy transfer.

Figure 6:
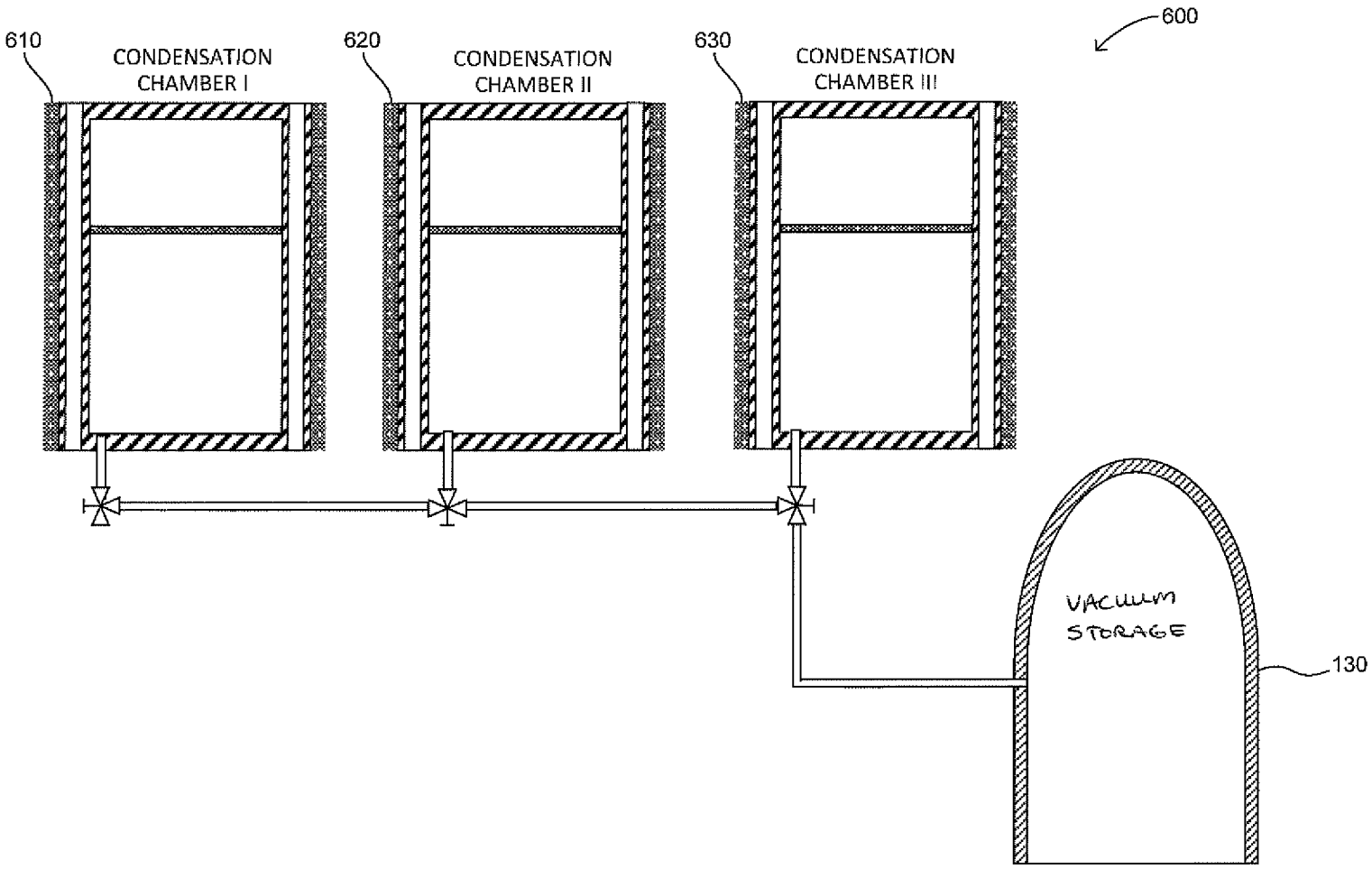
FIG. 6 is an illustration of an exemplary continuous vacuuming operation to the vacuum storage, involving a cascade condensation chamber system.

FIG. 6 is an illustration of an exemplary continuous operation involving a cascade condensation chamber system 600 or an integrated condensation-buffer chamber system. In this example, three condensation chambers 610, 620, 630 are used, however depending on the implementation two or more condensation chamber may be used in this system 600.

Figure 7:
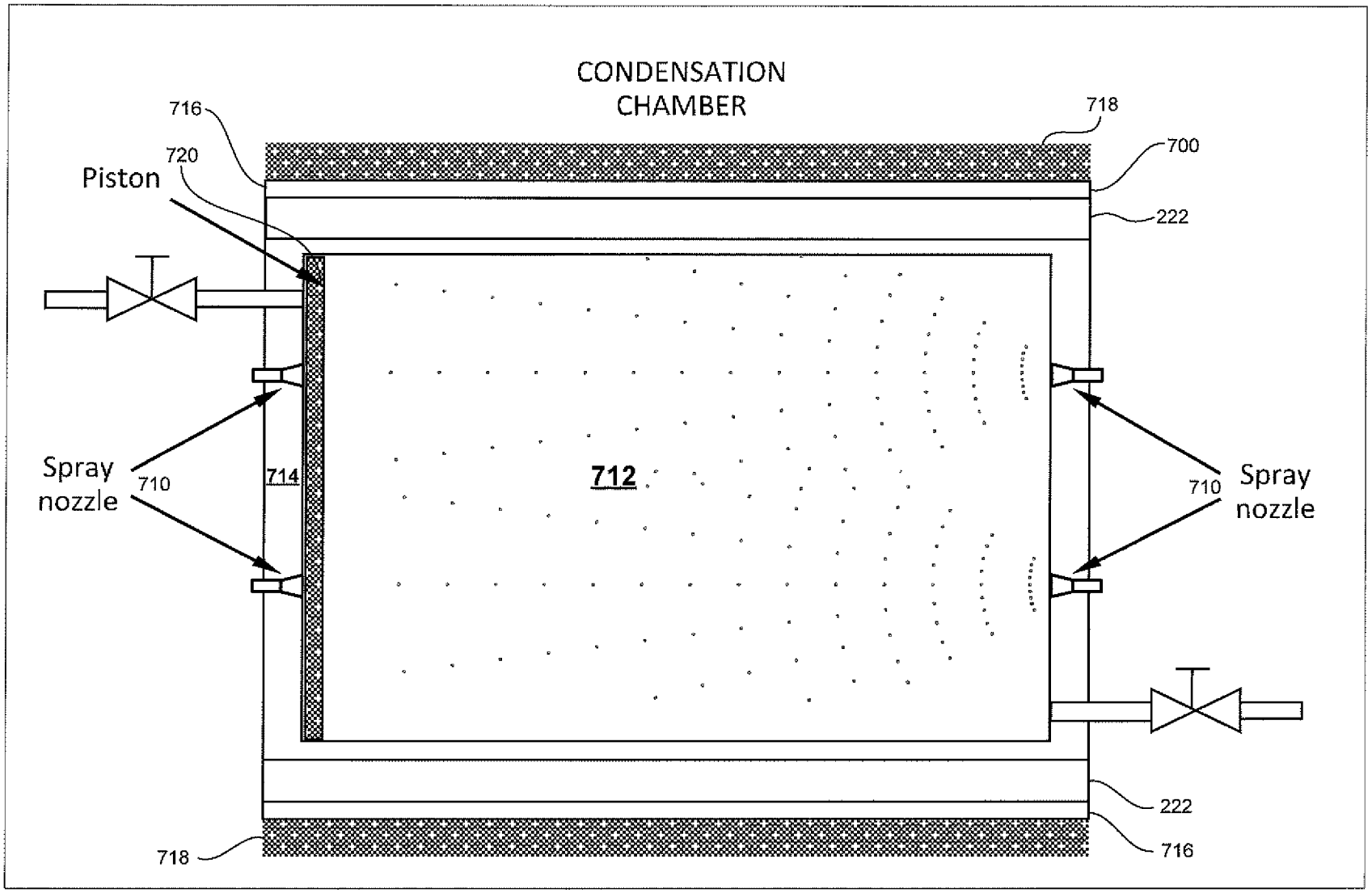
FIG. 7 is an illustration of a condensation cylinder with atomizing spray nozzles for enhanced cooling condensation and an exemplary arrangement with atomizing spray nozzles for enhanced cooling condensation inside the cylinder chambers.

FIG. 7 is an illustration of an exemplary arrangement with atomizing spray nozzles 710. A cylinder 700 can be cooled by an atomized spray of water into its chambers 712, 714, for example, with piston 720 retracted into chamber 714 in this example. This spray nozzles are in addition to the cooling through the wall-embedded channels 222 within the cylinder walls 716. Insulation 718 may be used in cylinder 700 as in the other embodiments to contain thermal and cooling energies within the cylinder 700. The injection of atomized fine droplets provides a large surface exposure for additional heat transfer and condensation, as well as enhanced condensation thermal capacity and prolonged contact time for phase changes. While FIG. 7 shows four spray nozzles, it will be understood that the number of spray nozzles could vary.

Figure 8:
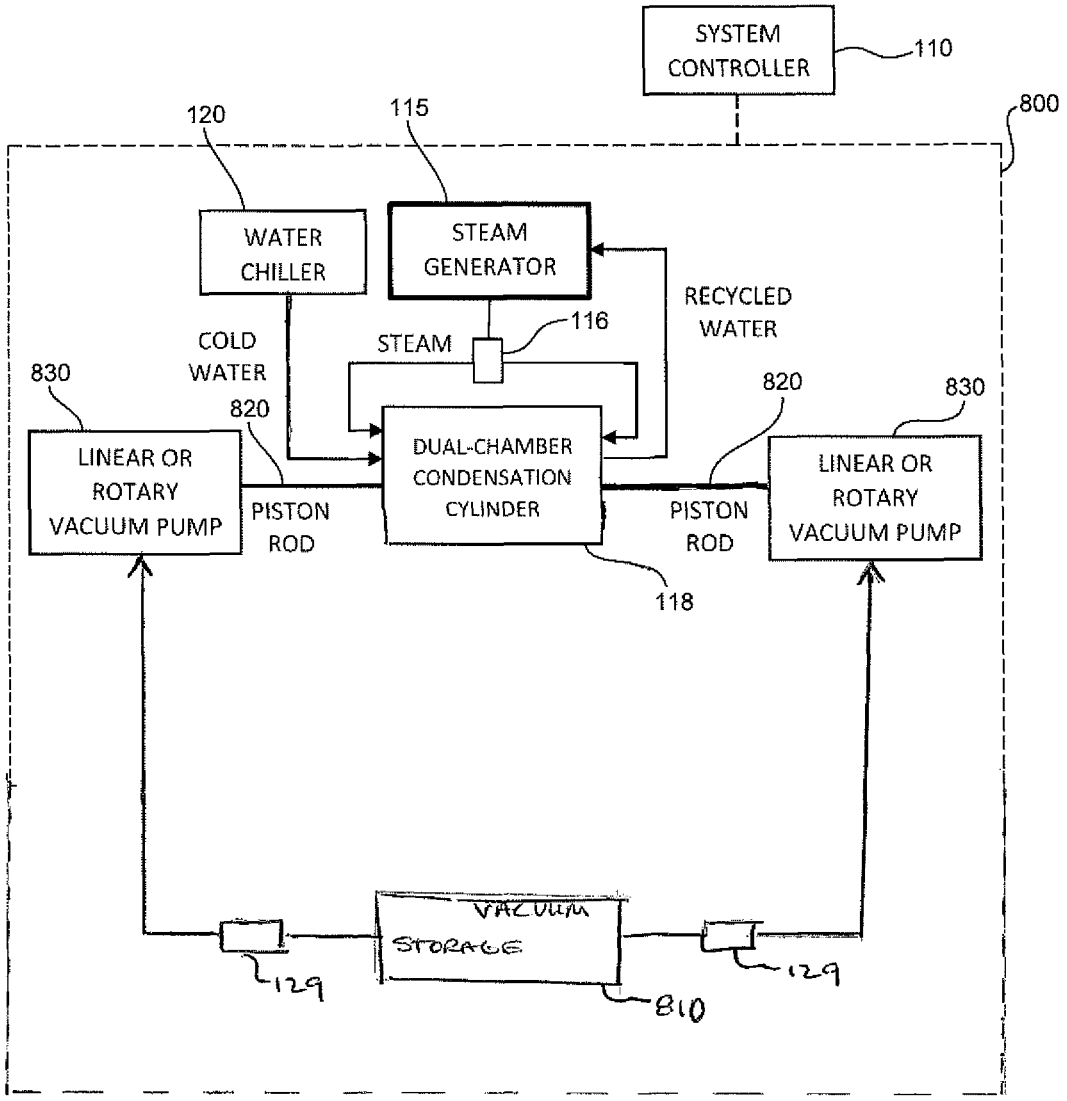
FIG. 8 is an illustration of an exemplary functional block diagram of a Dual-Action Piston-Cylinder Actuation and Rough/High Vacuum Generation System according to the present disclosure.

FIG. 8 is an illustration of an exemplary functional block diagram of a dual-action piston-cylinder for condensation-based actuation and rough/high vacuum generation system 800. The system could include the same components and work in the same way as discussed in the previous figures for rough vacuum generation, except that some of the condensation cylinders are configured as the variations 3 or 4 in FIGS. 4B, and 4C. The rough vacuum generated inside the dual-chamber condensation cylinder is not used to evacuate a vacuum storage directly. Instead it is now used to work together with the steam to move the piston rod 820. The reciprocating linear motion of the piston rod can then drive a linear or rotary compression cylinders (vacuum pumps) 830 through an external rack and pinion mechanism. Those external vacuum pumps can be used to generate or maintain rough/high vacuum in vacuum storage 810 or other targeted applications. A vacuum storage 810 is in communication with linear or rotatory vacuum pumps 830. The flow of the high vacuum storage 810 to a linear or rotary compression cylinders (vacuum pumps) 830 is, depending on the embodiment, controlled by a two-position gas valve 129. When a condensation cylinder is used as an actuator, the movement speed of the piston will be reduced due to the load applied on the piston rod by the vacuum pumps that it is coupled with. Therefore the piston seal needs to be tighter, compared with the no-load configuration. Preheating of the cylinder wall before steam-filling might be necessary to minimize the pre-matured condensation of steam during the steam-filling.

Figure 9:
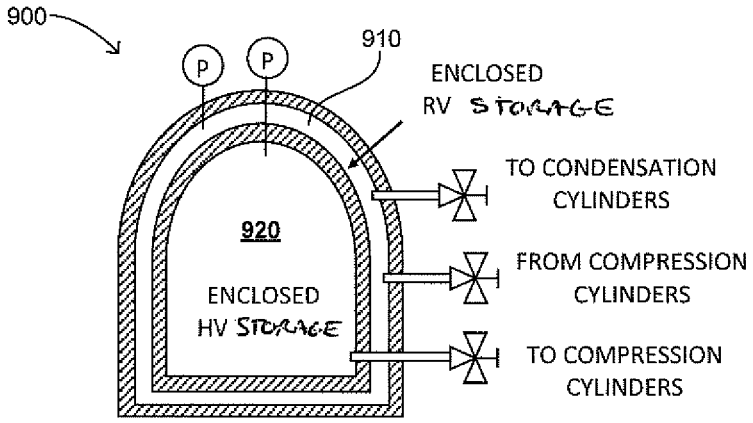
FIG. 9 is an illustration of an exemplary multi-level vacuum storage, showing a rough vacuum storage and a high vacuum storage, according to the present disclosure.

FIG. 9 is an illustration of an exemplary multi-level vacuum storage and application 900 according to an embodiment of the present disclosure. The system could comprise two or more vacuum storages 910 and 920 having a pressure "P" the same or different depending on the implementation, and functioned as rough and high vacuum storages for the rough vacuum and the high vacuum generated by the compression cylinders. Vacuum storage 910 is an enclosed RV (Rough Vacuum) storage and vacuum storage 920 is an enclosed HV (High Vacuum or Volume) storage. A multi-level vacuum storage reduces overall energy cost of attaining and maintaining the high vacuum in the enclosed HV storage. In addition, the reduced pressure difference between two neighboring multi-level storages leads to the reduction in mechanical stresses over their walls and hence reduces the material requirement and cost of each storage. Each of the enclosed vacuum volumes is connected to the compression cylinders through ducts and control valves for attaining and maintaining the vacuum level.

Figure 10:
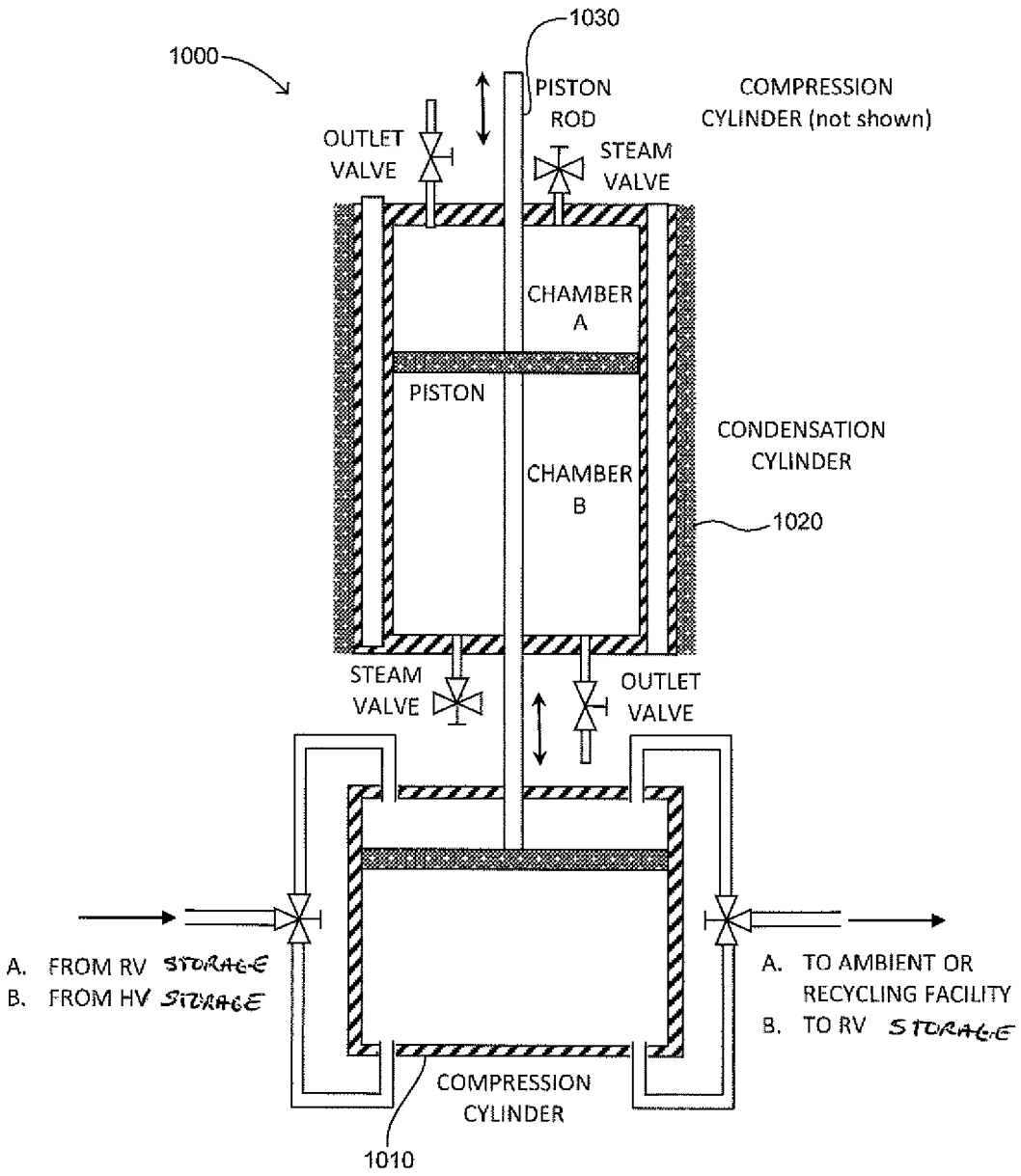
FIG. 10 is an illustration of an exemplary axial arrangement of condensation cylinder, condensation-based actuator, and compression cylinders for rough and high vacuum generation (only one pump is shown) according to the present disclosure.

FIG. 10 is an illustration of an exemplary piston-cylinder condensation-based linear actuator system 1000 for higher-level vacuuming or high vacuum generation. The driving force of the linear actuator is proportional to the pressure difference between the feeding steam on one side and rough vacuum on the other side of the pistons as well as to the cross-sectional area of pistons. Only an exemplary axial arrangement of condensation cylinder (i.e., condensation-based actuator) and compression cylinders is shown in this example. Other embodiments may apply to this system. The stroke distance of the compression cylinder 1010 can be different from that of the condensation cylinder 1020 through a gear mechanism. One variation to the axial arrangement of condensation cylinder and compression cylinders may include parallel arrangement with compression cylinders placed around the condensation cylinder. Another variation is to mechanically convert the linear motion of the rod into rotary motion of a crank through rack and pinion. The rotation of the crank drives other reciprocating pumps such as piston pumps or diaphragm pumps. A speed multiplying gearing set is then used to produce higher speed rotation for driving reciprocating pumps through in-line crank-slider mechanism. For maintaining continuing smooth operation of the pumps when the piston and rack reverse directions, the corresponding position of the crank should be designed to produce a transmission angle near 90° in the crank-slider mechanism, when the piston and rack change their direction of motion. Two exemplary options, A and B, for interacting with a multilevel vacuum storage is shown in FIG. 10. In option A, the gaseous content evacuated by the compression cylinder from the RV storage could be pushed into ambient or recycling facility directly. In option B, the gaseous content evacuated by the compression cylinder from the HV storage could be pushed into the RV storage, for reducing the pressure difference between the two sides of the piston in the compression cylinder, instead of being pushed directly into ambient or recycling facility.

The rod 1030 of the condensation cylinder in FIG. 10 could be mechanically coupled to a plurality of compression cylinders or reciprocating pumps, for example, pumps 1 to M, where M is an integer. The number M can be any number greater than or equal to one. The number M may be chosen based on, for example, but without limitation, a flow rate control, a compression cylinder cost, the pressure in the vacuum storages, and the steam pressure for moving the piston of the condensation cylinder. The rod of the condensation cylinder can be individually coupled or decoupled to the compression cylinders with controllable mechanical couplings. The controller selects a number of compression cylinders for rough vacuum generation and another number of pumps for high vacuum generation according to the specific needs. The total number pumps selected for each operation cycle can be less than or equal to M.

The controller coordinates the movements of the pistons in the compression cylinders in FIG. 10 by controlling the valves to allow the first quantity of the gas in the corresponding vacuum storages to flow into the first chambers in each of the compression cylinders. The outlet valves are controlled simultaneously to expel any gas present in the second chambers of the compression cylinders into rough vacuum storages or ambient or a recycling facility.

The embodiments in FIGS. 1, 2, 8, and 10 show one condensation cylinder, but any number of additional condensation cylinders may be used to obtain the required pressure in the enclosed rough vacuum storage, as well as actuate the compression cylinders. Any number of additional compression cylinders may be used in FIGS. 8 and 10 to obtain the required pressure in the RV and/or HV storages.

FIG. 8 shows the use of a pump on either side of the condensation cylinder. How the pump evacuates the rough vacuum storage is further illustrated in FIGS. 11-22 that shows and describes a complete cycle of the dual-action piston cylinder system.

The tasks in the process for driving compression cylinders are different from the tasks in the process of generating vacuum to directly evacuate a vacuum storage, except for the first 5 tasks. These 5 tasks are now labeled as tasks 1* to 5*.

The process could then continue by inserting a first quantity of the hot water into the wall channels of the condensation cylinder to repel the cold water in the channel and heat the cylinder (task 6*).

The process could then continue by inserting a second quantity of the steam into the second chamber of the condensation cylinder (task 7*).

The process could then continue by moving the piston inside the condensation cylinder, under the action of the second quantity of steam and rough vacuum in the first chamber cylinder, to increase the volume of the second chamber and reduce the volume of the first chamber (task 8*). The rods also move the pistons of the compression cylinders through mechanical couplings.

The process could then continue by opening the outlet valve of the first chamber of the condensation cylinder to expel any condensate present within the chamber when the pressure reaches ambient pressure such as 1 atm (task 9*). The outlet valve is closed when the piston reaches the end of the cylinder.

The process could then continue by moving the pistons of the compression cylinders, under the action of the pistons of the condensation cylinder, to increase the volumes of their first chambers and reduce the volumes of their second chambers (task 10*). The valves to the vacuum storage are opened to receive gas into the first chambers of the compression cylinder. The outlet valves are opened to expel gas in the second chamber of the compression cylinder into the rough vacuum storage (for high vacuum generation) or into ambient or a recycling facility (for rough vacuum generation).

The process could then continue by blocking the steam flow into the second chamber of the condensation cylinder and inserting a second quantity of the cold water into the wall channels of the condensation cylinder to repel the hot water in the channel to condense substantially the second quantity of steam in the second chamber of the condensation cylinder (task 11*).

The process could then continue by inserting a second quantity of the hot water into the wall channels of the condensation cylinder to repel the cold water in the channel and heat the cylinder (task 12*).

The process could then continue by moving the steam valve to insert a third quantity of steam into the first chamber of the condensation cylinder (task 12*). The third quantity of steam and rough vacuum in the second chamber of the condensation cylinder moves the piston to increase the volume of the first chamber and reduce the volume of the second chamber; the rods also move the pistons of the compression cylinders through mechanical couplings in another direction.

The process could then continue by moving the pistons of the compression cylinders to increase the volume of their second chambers and reduce the volume of their first chambers (task 13*). The valves to the vacuum storage are opened to receive gas in the second chambers of the compression cylinder. The outlet valves are opened to expel gas in the first chambers of the compression cylinder into the rough vacuum storage (for high vacuum generation) or into ambient or a recycling facility (for rough vacuum generation).

The process could then continue by opening the outlet valve of the second chamber of the condensation cylinder to expel any condensate present within the chamber (task 14*), when the pressure in the second chamber of condensation cylinder reaches 1 atm. As the second action completes, the cycle of dual-action completes.

In this manner, a steam is introduced into an enclosed chamber of condensation cylinder and is then cooled to induce condensation of the steam. A dual-action piston-cylinder system produces piston movement with steam and vacuum generated by condensation and rod of the piston actuate the compression cylinders. In this manner, a multi-level vacuum generation system with reduced complexity and energy cost is established.

While at least one example embodiment has been presented in the foregoing detailed description, it should be appreciated that a vast number of variations exist. It should also be appreciated that the example embodiment or embodiments described herein are not intended to limit the scope, applicability, or configuration of the subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

The above description refers to elements, nodes, or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-10 depict example arrangements of elements, additional intervening elements, devices, features, or components may be present in an embodiment of the disclosure.

The above description refers to water and its vapor form as the working substance in the condensation cylinder and the operation is based on the vapor-to-liquid phase change of the steam. Many other substances with suitable vapor-to-liquid phase change temperature and pressure can also be used as the working media in the systems of the present disclosure.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

A method is provided for reducing pressure to a rough or high vacuum state in a vacuum storage or an open flow system with a piston-cylinder condensation and compression through a dual-action cycle. In one embodiment, the method includes inserting a first quantity of steam into a first chamber of a condensation cylinder, condensing the first quantity of steam in the first chamber, and compressing a first quantity of gas in the compression cylinder from an enclosed vacuum volume or an open flow system, inserting a second quantity of steam into a second chamber of a condensation cylinder, condensing the second quantity of steam in the second chamber, and compressing a second quantity of gas in the compression cylinder from an enclosed vacuum volume or an open flow system.

The method comprises performing heat exchange with the steam inside a cylinder with embedded channels in its heat conducting wall along its axis and/or with atomizing spray. The method also includes a free-moving piston separating two chambers of variable volumes within the condensation cylinder, a pressurized steam (steam at elevated temperature) moves the piston to increase the volume of one chamber while decreasing the volume of the other chamber, and external actuation is not required for the movement of the piston in the condensation cylinder. The method includes moving a three-position steam valve to substantially fill the first chamber with the first quantity of steam. The method includes substantially expelling the first quantity of gas and water condensate through a first outlet from the second chamber by the piston movement during an insertion of the first quantity of steam into the second chamber. The method comprises moving the three-position steam valve to block a first steam flow of the first quantity of steam into the first chamber.

The method comprises opening the cold water valve to allow the flow of the first quantity of cold water from the water chiller to cool the cylinder and condense the first quantity of steam in the first chamber. The method comprises moving the three-position steam valve to substantially fill a second chamber with a second quantity of steam. The method includes substantially expelling the second quantity of gas and water condensate through a second outlet from the first chamber by the piston movement during an insertion of the second quantity of steam into the second chamber.

The method includes moving the three-position steam valve to block the second steam flow of the second quantity of steam into the second chamber. The method includes condensing the second quantity of steam in the second chamber, thereby starting the next cycle of the dual-action. The method provides significant cost saving on energy consumption due to more efficient use of steam as well as time saving in gas expelling process.

A rough vacuum generation system comprises a condensation cylinder operable to receive alternatively a first quantity and a second quantity of steam into its two chambers, a plurality of channels in the cylinder wall operable to allow flows of cold water through them to perform heat exchange with the content inside the cylinder, a plurality of atomizing spray nozzles at the ends of the cylinder operable to spray cold water through them to perform heat exchange with the content inside the cylinder, a steam generator to provide the first and the second quantities of steam, and a water chiller to condense the first and second quantities of steam such that a vapor-to-liquid phase change reduces a pressure in the two chambers alternatively to provide a rough vacuum state.

A multi-level vacuum storage comprises at least one rough vacuum storage and one high vacuum storage, operable to interact with a rough vacuum compressor and a high vacuum compressor to attain and maintain proper vacuum states.

A vacuum generation system comprises a compression cylinder operable to receive alternatively a first quantity and a second quantity of gas from a vacuum storage into its two chambers, a piston and rod operable to move inside the compression cylinder under the force exerted by the piston rods of the condensation cylinder.

The system includes a three-position steam valve coupled to the condensation cylinder and operable to regulate the first and the second quantities of steam. The three-position steam valve may be replaced by a pair of two-position steam valves, operable to open/close alternately. The system includes enclosed multi-level storages or open flow systems coupled to the valves and operable to provide a reduced gas pressure in the enclosed storages or open flow systems. The system includes valves coupled to the compression cylinder and operable to reduce pressure in the vacuum storage or open flow system.

The system further includes a controller operable to control the steam valve, gas valve, cold water valve and outlet valves. The cold water may be replaced by other coolants in condenser, which however requires separate channels in the cylinder wall.

The water and steam could be the working medium and recyclable, which is very environment friendly. Other condensable gases may be used to replace water and steam to reach lower pressure limits. The capacity and efficiency of the process depend mainly on the heat transfer rate of cooling and condensation temperature, and are nearly independent of volume and shape of the cylinder, thereby ensuring the scalability of the process. The disclosed system involves limited number of moving parts and mostly in linear motions, and hence generates little flow-induced noise and few mechanical vibrations. The electricity usage is mainly for the associated control needs, cold water pumping and chiller operation, compared to the huge demand of electric power in existing commercial vacuum technologies.

Use of vacuum as an industrial process technology is largely driven by the electronics industry. There are also many chemical, petrochemical and pharmaceutical applications, such as evaporation, condensation, freeze-drying, distillation, deodorization, degassing, absorption, and impregnation. Vacuum evaporation and distillation is now also used in wastewater treatment technology, resulting in a dramatic reduction in the volume of liquid waste, which allows effluents that cannot viably be treated using physicochemical or biological techniques to be treated in a clean, efficient, safe and compact manner.

Vacuum-assisted pneumatic conveying, also known as negative-pressure conveying, has been widely used for transport of particulate (such as rice, beans, pulverized coal, granular ores or chemicals) via pipelines. The vacuum-assisted pneumatic conveying is extremely useful in the transport of toxic and hazardous materials since this type of conveyance not only provides dust-free feeding but also prevents the escape of solids through leakage (if any) in the pipeline. In addition, vacuum cleaning at industrial sites constantly requires large-scaled low-cost vacuum technology.

Another application involves high-volume aerosol filtration technology. The high efficient aerosol filtration system, such as High-Efficiency Particulate Arrestance (HEPA) filter for removal of ultrafine particulates such as PM2.5, typically require a high pressure head to overcome the high pressure drop that increases in a quadratic function with the increase in flowrate. This disclosed vacuum technology provides an ideal flow driving solution, which is low energy cost, high pressure difference and low noise, to the ever-growing needs of filtrations of ultrafine aerosols.

Current vacuum technology consists of positive displacement pumps, momentum transfer pumps, and entrapment pumps to generate sub-atmospheric pressure at different vacuum levels. Pumping and pumping services comprise about two-thirds of the market. The pump shaft speed has steadily increased to meet the greater demand on capacity. There is, however, a fundamental limit to the maximum speed that can be achieved by a particular pumping technology, since it takes time to make a gas to flow into a space, especially at a low pressure. Vacuum pumps are typically very noisy and costly to be applied to very large enclosed volumes due to the tremendous energy consumption involved. The system may be developed to replace many, if not most, of the existing vacuum pumps for obtaining a rough and high vacuum.

FIGS. 11-22 illustrate a complete cycle of the dual-action piston cylinder. The valves include one 3-way steam distribution valve V1 (242) that is used to distribute steam to either side of the cylinder. Two 3-way steam/air switch valves V2A and V2B (244) are used to direct the flow of steam from the steam distribution valve V1 (242) or the flow of air from the application volume through valve V4 (240) into the cylinder. Two air and condensate exit valves V3A or V3B (250), one on each side of the cylinder, are used to allow the air and condensate inside the cylinder to be pushed out by the piston into the ambient. One 3-way air valve V4 (240) is used to direct air from the application volume to the valves V2A and V2B (244). One water supply valve V5 (235) is used to control the flow of the cold water into cylinder wall channels 222.

Initially all the valves are closed. Once the steam pressure reaches the designed level as defined by a particular user, and the pressure is detected by a pressure switch, the vacuum generation cycle can be started. For the convenience of discussion, it is assumed that the operation starts from the chamber A (221) of the cylinder. The following is an exemplary method of operation for the dual-action piston cylinder.

Step A1: Steam distribution valve V1 (242) is switched to the side A of the cylinder. Steam/air switch valve V2A (244) is switched to allow the flow of steam from the steam distribution valve V1 (242) into the chamber A of the cylinder. The steam pressure pushes the piston to move towards the end of the side B. The piston movement increases the volume of chamber A and fill it with the steam. In the same time the piston movement decreases the volume of chamber B (223), which compresses its content and increases the pressure inside chamber B. When the pressure inside the chamber B reaches the ambient pressure, which is detected by another pressure switch, the air and condensate exit valve V3B (250) is opened to allow the air and condensate inside the chamber B to exit into the ambient. When the piston reaches to the end of side B, which is detected by a contact switch on the end plate of the side B, the air and condensate exit valve V3B (250) will close. Valves V1 (242) and V2A (244) will also close. Step A1 is now complete and chamber A is filled with the steam.

Step A2: Cold water supply valve V5 (235) is now opened to allow the flow of the cold water into cylinder wall channels (222) to induce condensation of steam inside the chamber A. The continued condensation of steam will reduce the pressure inside the chamber into vacuum state. Once the vacuum level reaches the designed level, which is detected by a pressure switch, the cold water supply valve V5 (235) is closed to stop the flow of the cold water into cylinder wall channels (222). Step A2 is now complete and chamber A is filled with vacuum.

Step A3: Air valve V4 (240) is switched to the side A of the cylinder. Steam/air switch valve V2A (244) is switched to allow the flow of air from the application volume into the cylinder. Air is now entering into chamber A of the cylinder and increases the pressure inside chamber A. When the pressure inside the chamber A reaches the designed level, which is detected by a differential pressure switch, both valves V4 (240) and V2A (244) will close. The designed pressure level for evacuation must be lower than the desired pressure inside the application volume by a predetermined amount to ensure a minimum flow rate of evacuation. Step A3 is now complete and chamber A is filled with the air.

Step B1: Steam distribution valve V1 (242) is now switched to the side B of the cylinder. Steam/air switch valve V2B (244) is switched to allow the flow of steam from the steam distribution valve V1 (242) into the chamber B of the cylinder. The steam pressure pushes the piston to move towards the end of the side A. The piston movement increases the volume of chamber B and fill it with the steam. In the same time the piston movement decreases the volume of chamber A, which compresses its content and increases the pressure inside chamber A. When the pressure inside the chamber A reaches the ambient pressure, which is detected by another pressure switch, the air and condensate exit valve V3A (250) is opened to allow the air and condensate inside the chamber A to exit into the ambient. When the piston reaches to the end of side A, which is detected by a contact switch on the end plate of the side A, the air and condensate exit valve V3A (250) will close. Valves V1 (242) and V2B (244) will also close. Step B1 is now complete and chamber B is filled with the steam.

Step B2: Cold water supply valve V5 (235) is now opened to allow the flow of the cold water into cylinder wall channels to induce condensation of steam inside the chamber B. The continued condensation of steam will reduce the pressure inside the chamber into vacuum state. Once the vacuum level reaches the designed level, which is detected by a pressure switch, the cold water supply valve V5 (235) is closed to stop the flow of the cold water into cylinder wall channels. Step B2 is now complete and chamber B is filled with vacuum.

Step B3: Air valve V4 (240) is switched to the side B of the cylinder. Steam/air switch valve V2B (244) is switched to allow the flow of air from the application volume into the cylinder. Air is now entering into chamber B of the cylinder and increases the pressure inside chamber B. When the pressure inside the chamber B reaches the designed level, which is detected by a differential pressure switch, both valves V4 (240) and V2B (244) will close. The designed pressure level for evacuation must be lower than the desired pressure inside the application volume by a predetermined amount to ensure a minimum flow rate of evacuation. Step B3 is now complete and chamber B is filled with the air.

After the above steps, one cycle of vacuum generation operation is completed. The cycle will repeat as long as needed.

When the same vacuum generation operation is used to create a prime mover or actuator, steps A3 and B3 are removed since the vacuum in the cylinder is no longer used for evacuate the application directly.

The outlets connected to valves V3A and V3B, 250 are the air and condensate exit outlets.

The function of the controller is to coordinate the open and close of all the valves according to the conditions and sequence described in the above steps.

Figure 11:
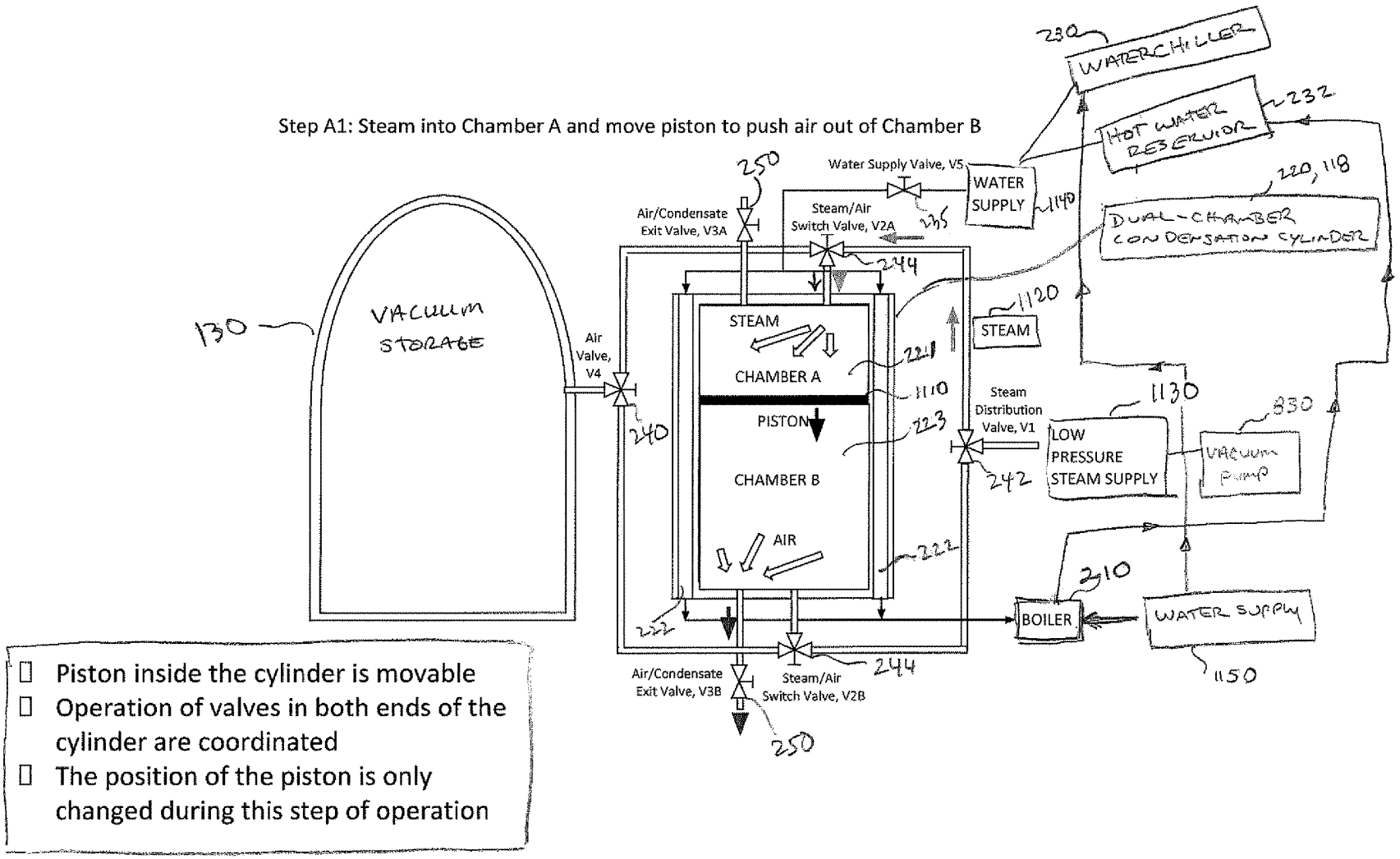
FIGS. 11-22 illustrate a complete cycle of the dual-action piston cylinder, step by step operation for chamber A, and followed for chamber B in the cylinder.

FIGS. 11-22 are sequential figures of the same embodiment showing operation steps of the vacuum generation using the dual-action piston cylinder system. In these figures common reference numbers previously used herein, have common functions as previously shown and described in for example FIG. 2 and FIG. 8 as well as other figures herein. FIG. 11 illustrates piston 1110 inside the cylinder 220, or 118 depending on the embodiment. Operation of the valves in both of the ends of the cylinder is coordinated. The position of the piston is only changed during the step of operation where steam enters the chamber and moves the positon to push air out of the opposite chamber. Steam 1120 in FIG. 11 enters chamber A to move piston 1110. A low pressure steam supply 1130 is in communication with vacuum pump 830 and steam distribution valve V1, 242 to supply steam 1120. Water supply 1140 includes water chiller 230 and hot water reservoir 232 as previously shown and described as reference to FIG. 2. Water supply 1150 feeds boiler 210 depending on the implementation. Boiler 210 is in communication with hot water reservoir 232. Water from channels or heat exchangers 222 also flow into boiler 210 as shown and previously described in FIG. 2. Water supply 1150 also fees water chiller 230.

Figure 12:
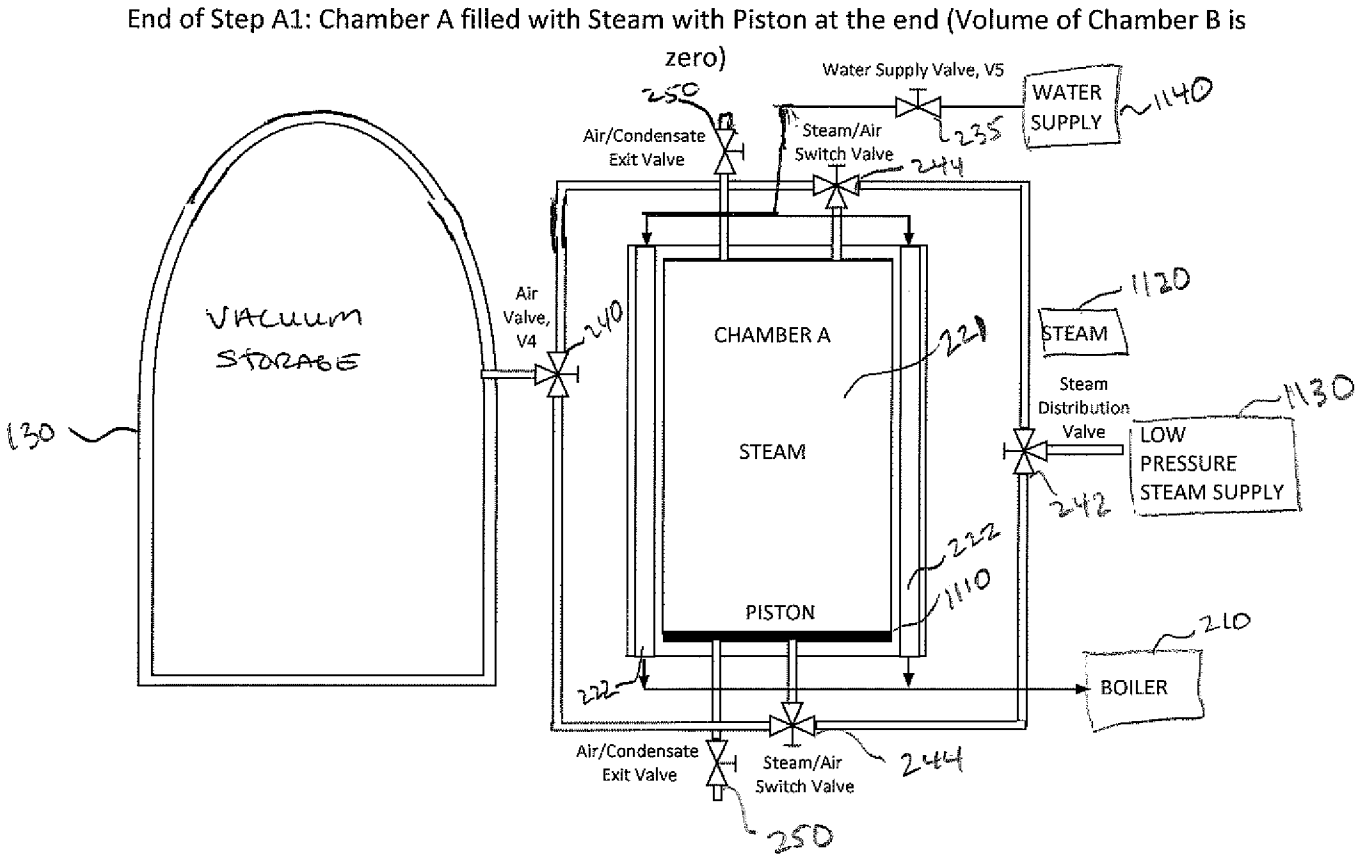

FIG. 12 illustrates chamber A being filled with steam with piston 1110 at an end of chamber A so that the volume of chamber B is now zero or negligible depending on the embodiment.

Figure 13:
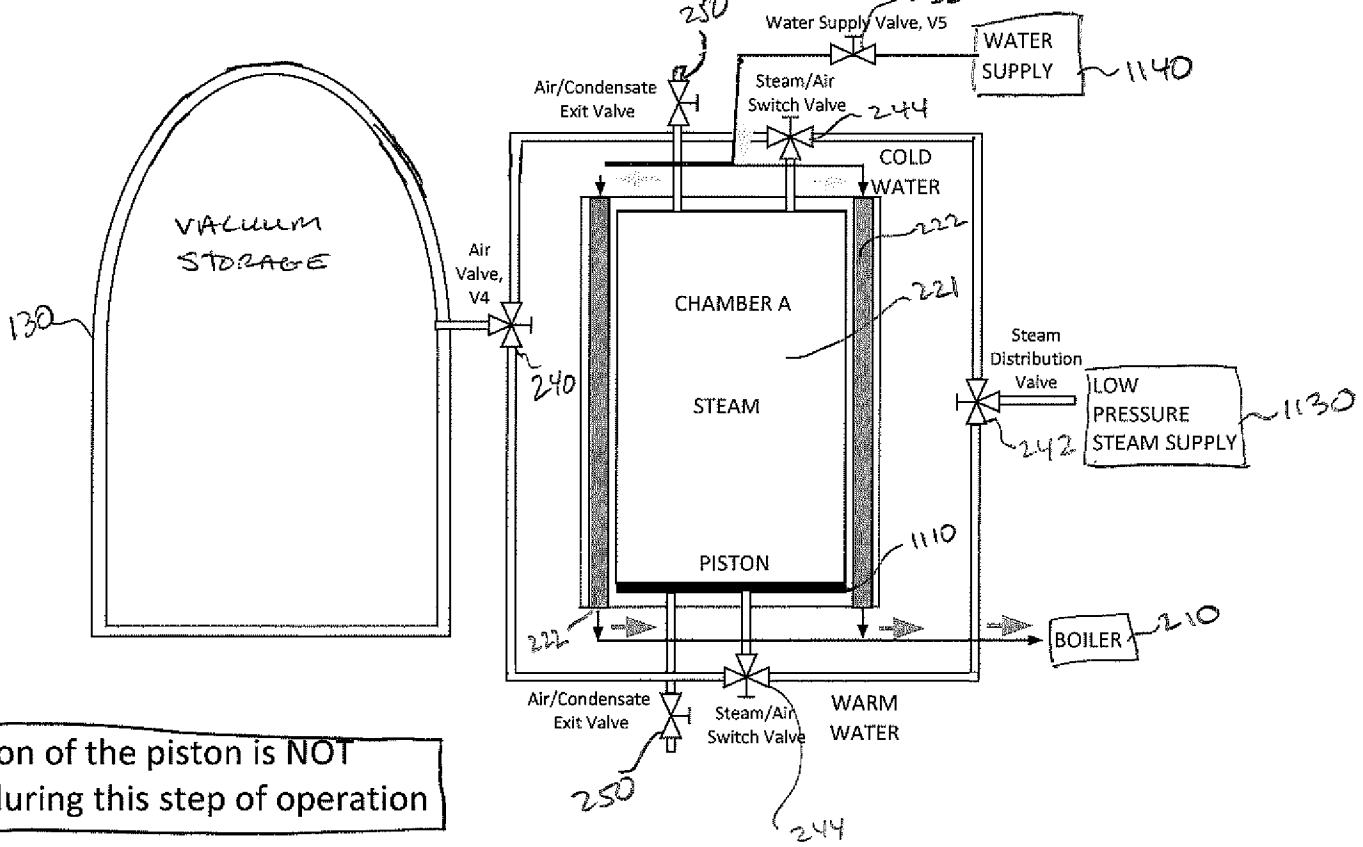

FIG. 13 illustrates cold water flowing into the cylinder wall channels 222 or also known as heat exchangers, to induce condensation of steam inside the cylinder within chamber A. The positon of the piston is not changes during this step of operation.

Figure 14:
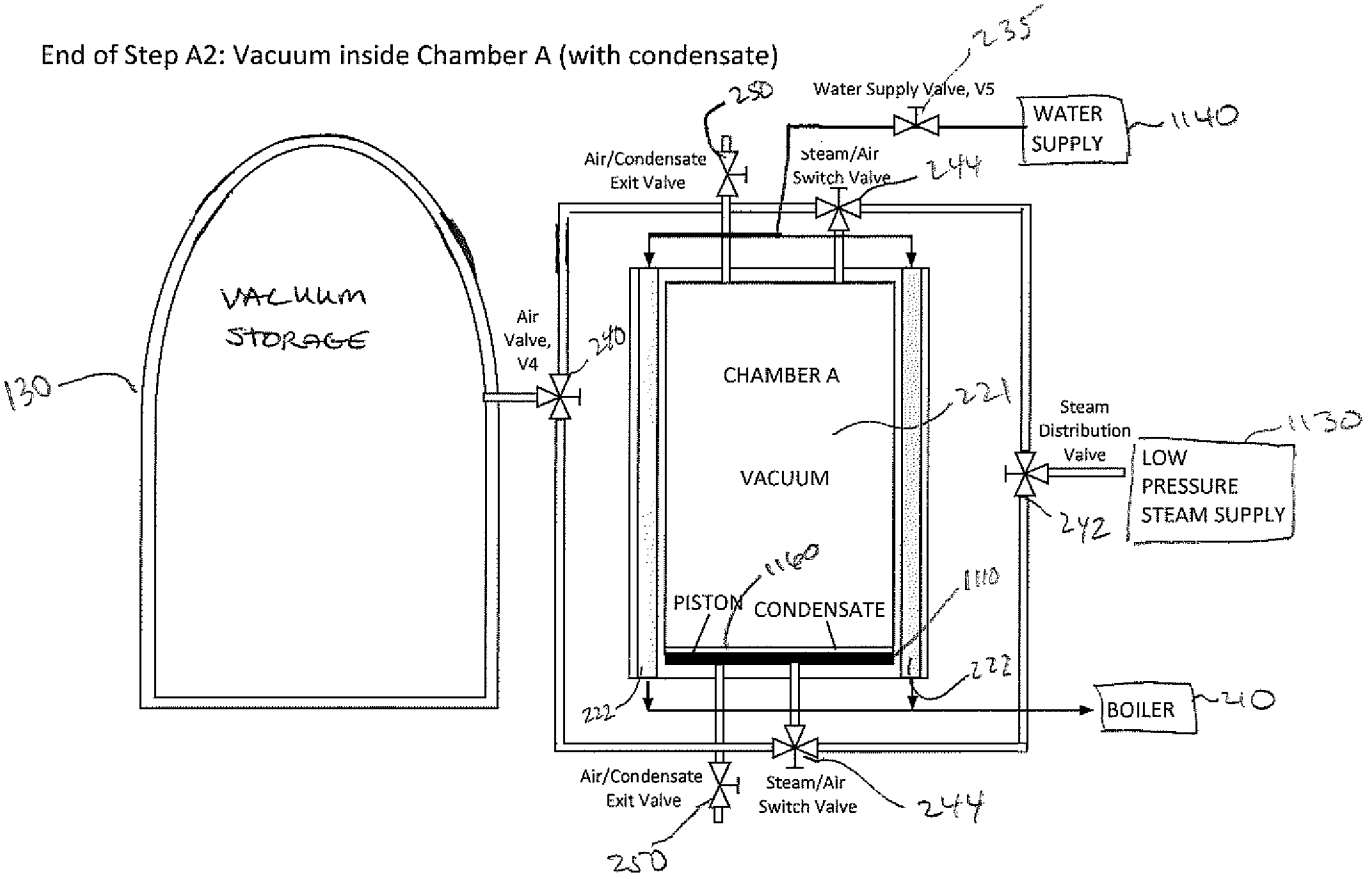

FIG. 14 illustrates creation or generation of a vacuum inside chamber A with a condensate 1160. The condensate, depending on the implementation, is mostly composed of water, however, may also be other fluids.

Figure 15:
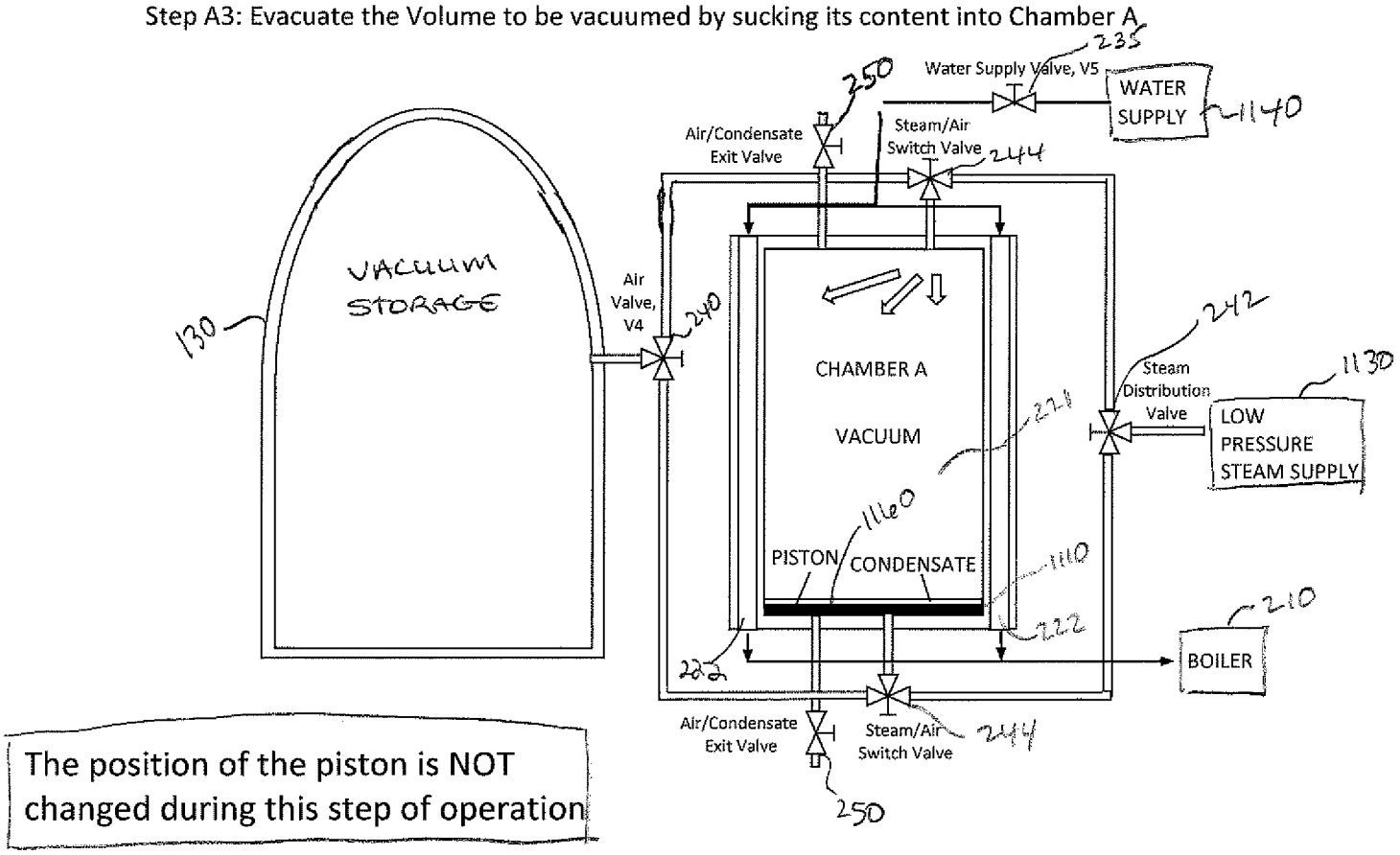

FIG. 15 illustrates evacuation of the volume to be vacuumed by sucking the contents of volume container 130 into chamber A. The position of the piston is not changed during this step of operation.

Figure 16:
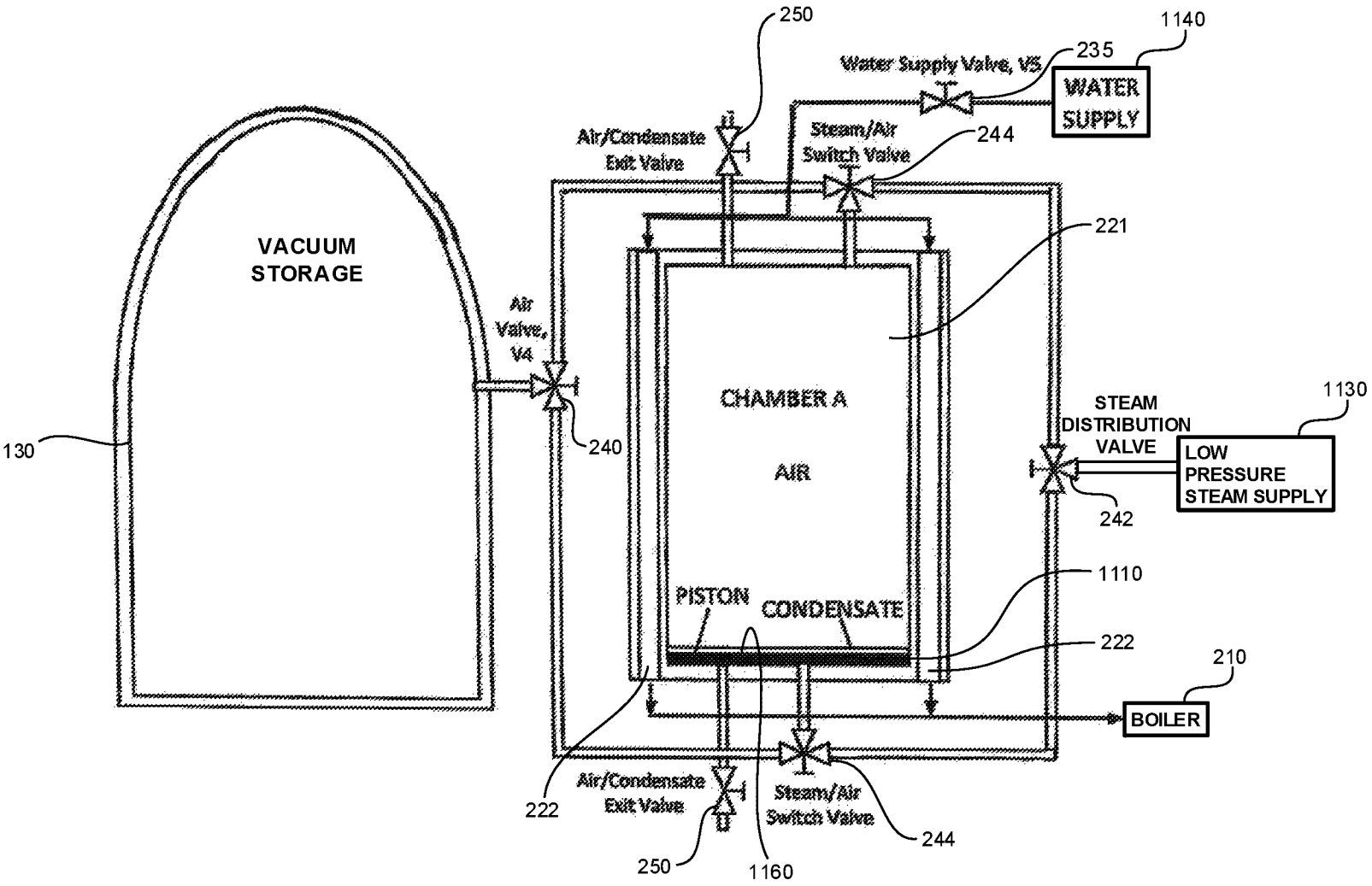

FIG. 16 illustrates chamber A being filled with content from container 130 that is to be vacuumed. Again the position of the piston is not changed.

Figure 17:
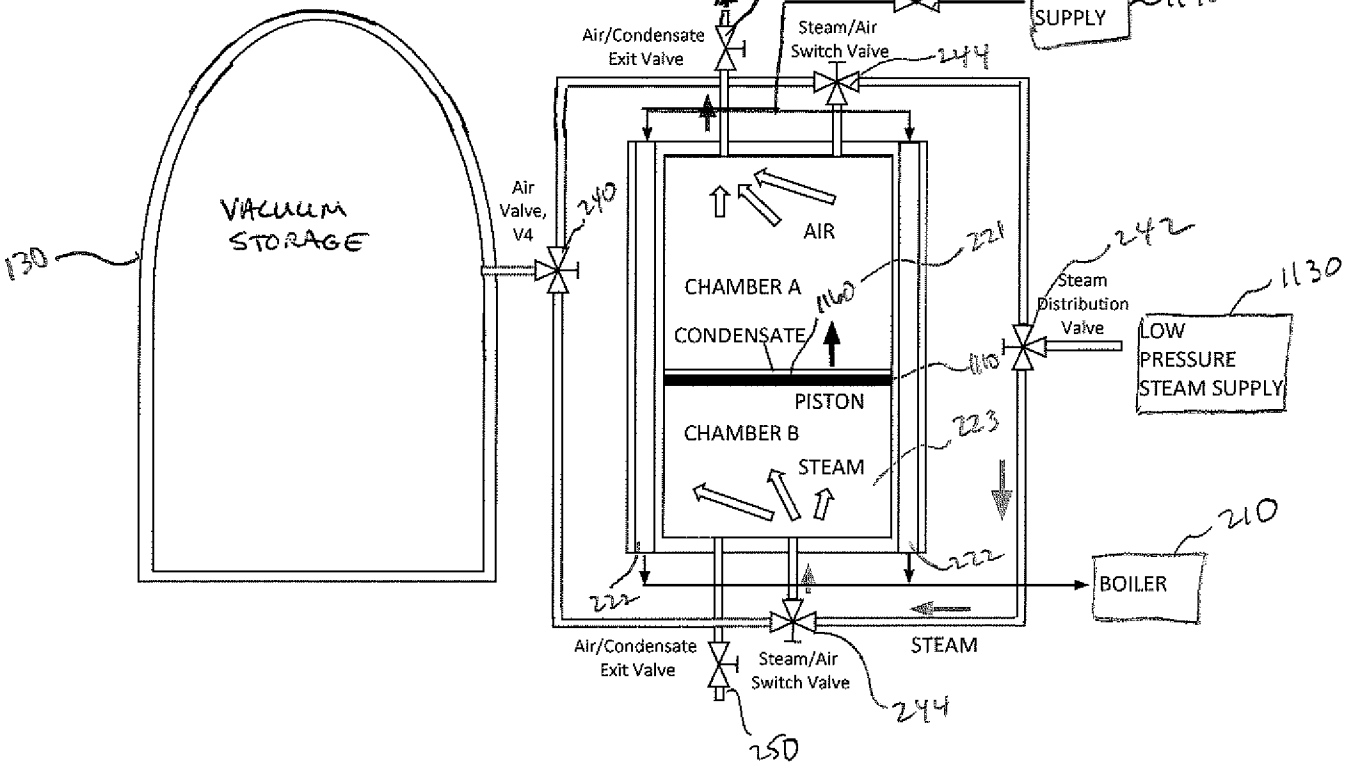

FIG. 17 illustrates the other side of the cylinder, side B. Shown in FIG. 17 is steam flowing into Chamber B 223 of the cylinder and the steam moving the piston 1110 to push air out of chamber A 221.

Figure 18:
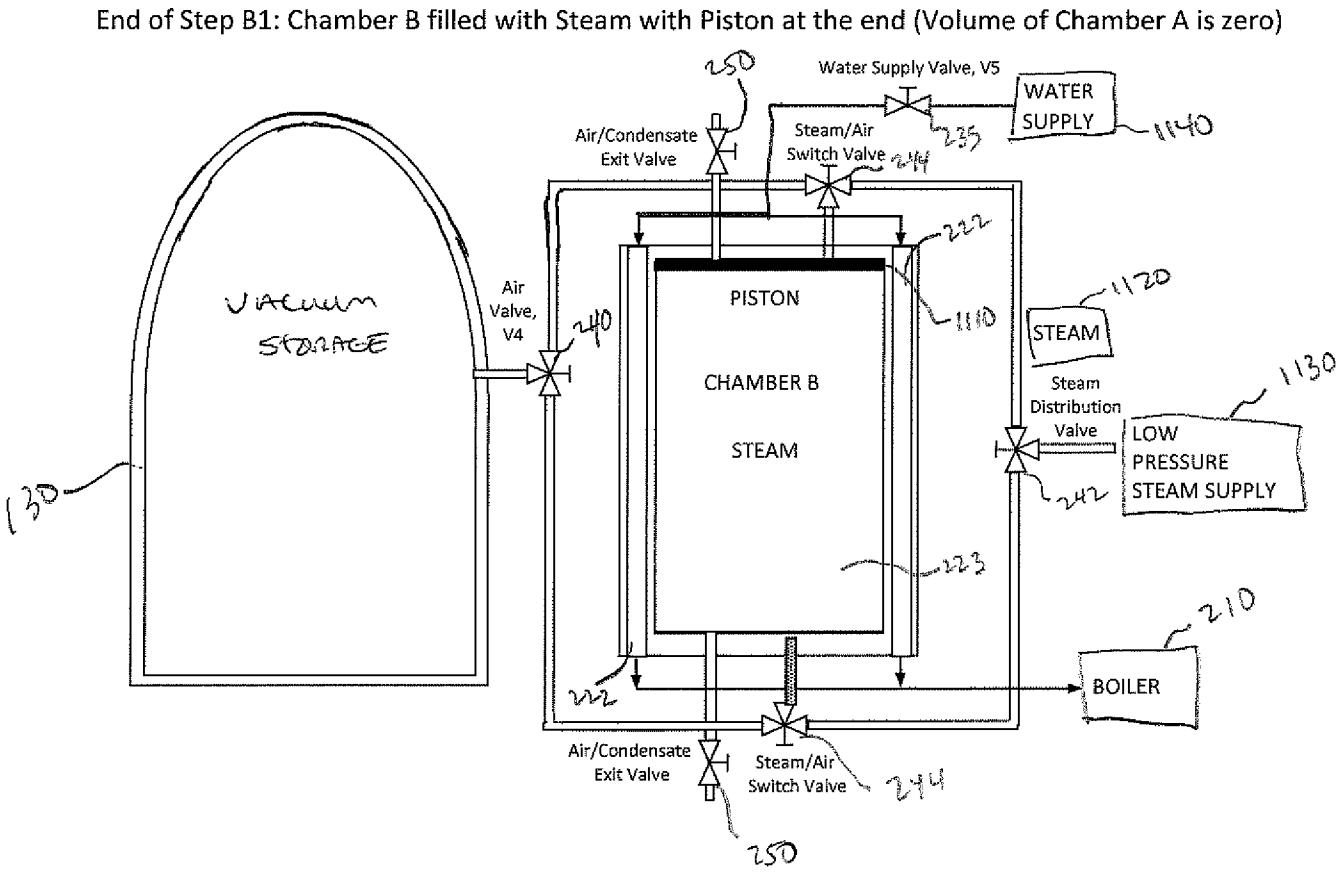

FIG. 18 illustrates chamber B 223 filled with steam with piston 1110 at the end of chamber A where the volume of chamber A is zero or negligible.

Figure 19:
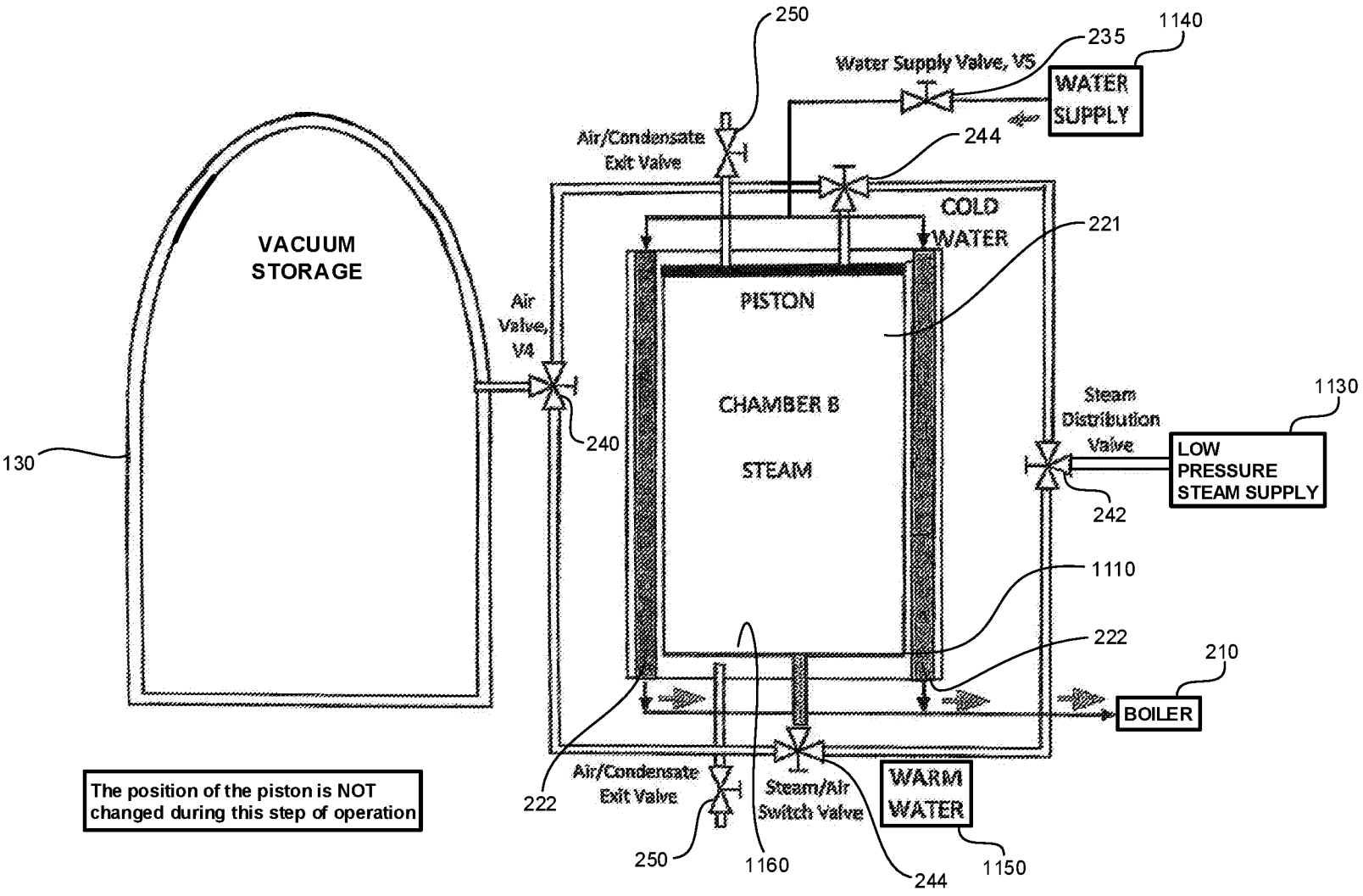

FIG. 19 illustrates cold water flowing into cylinder wall channels 222 or heat exchanger 222 to induce condensation of steam inside the chamber B 223. The position of the piston is not changed during this step of operation.

Figure 20:
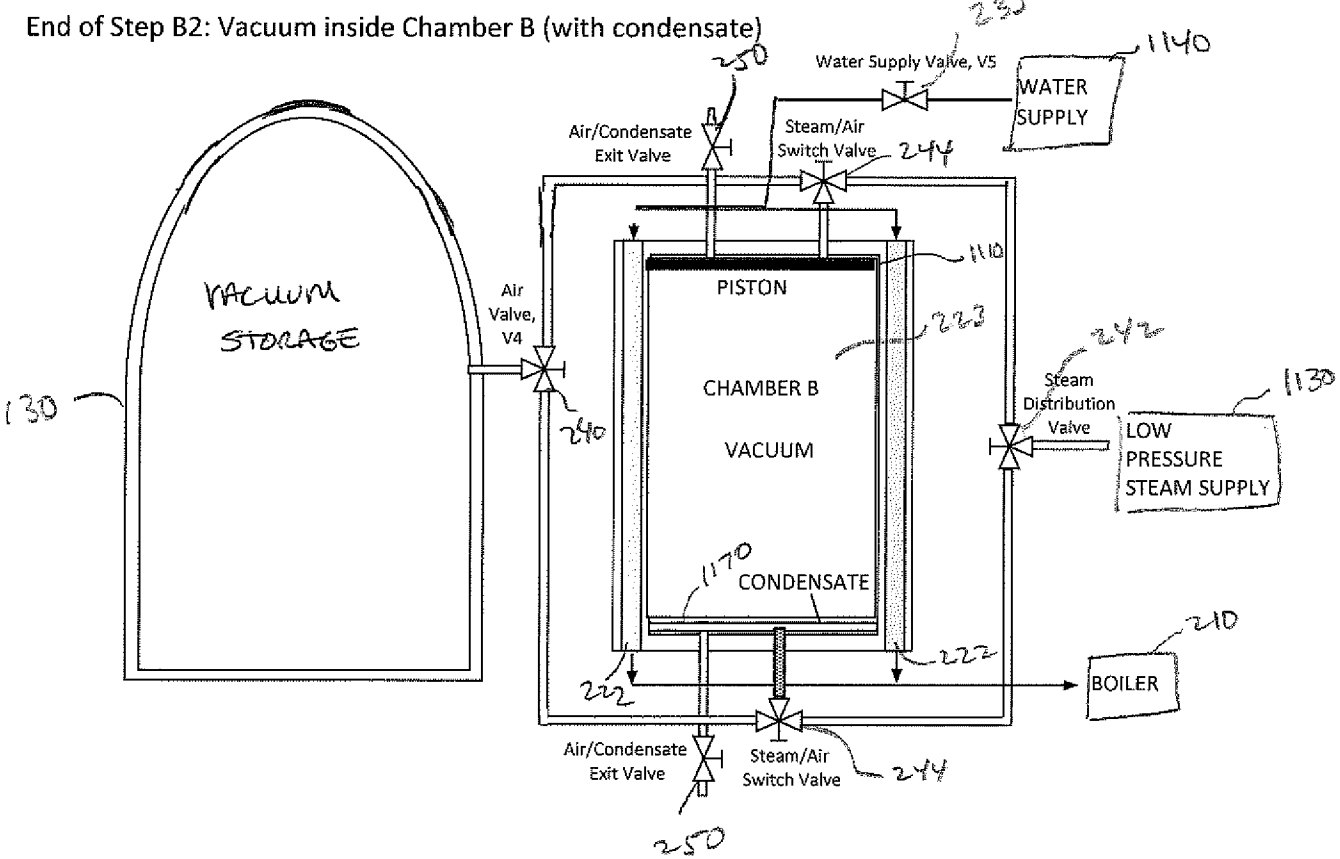

FIG. 20 illustrates the vacuum generated inside chamber B 223 with condensate 1770. Again, the piston position is not changed during this step of operation.

Figure 21:
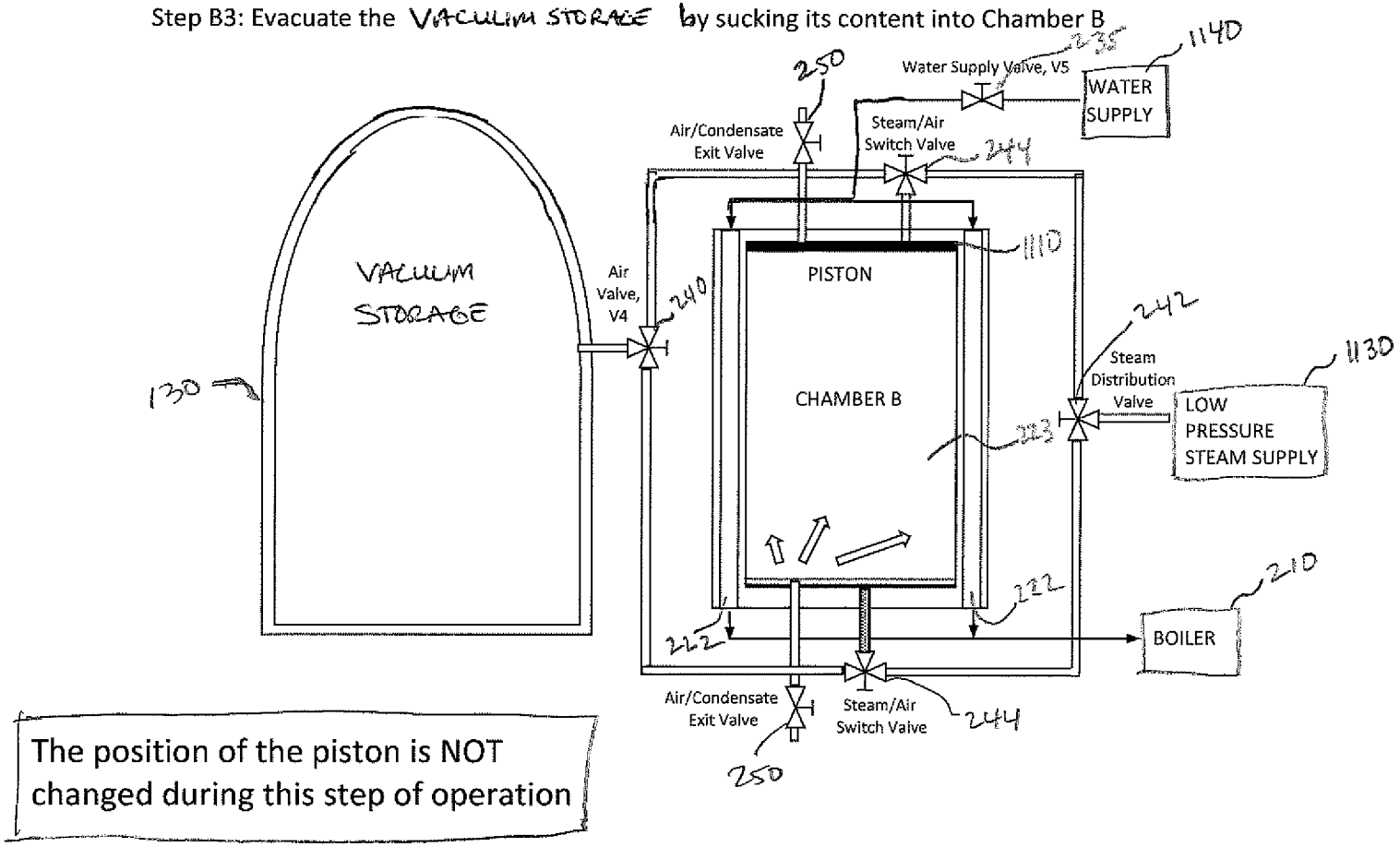

FIG. 21 illustrates evacuation of the volume in container 130 to be vacuumed by sucking its contents into chamber B 223. Again the position of the piston is not changed during this step of operation.

Figure 22:
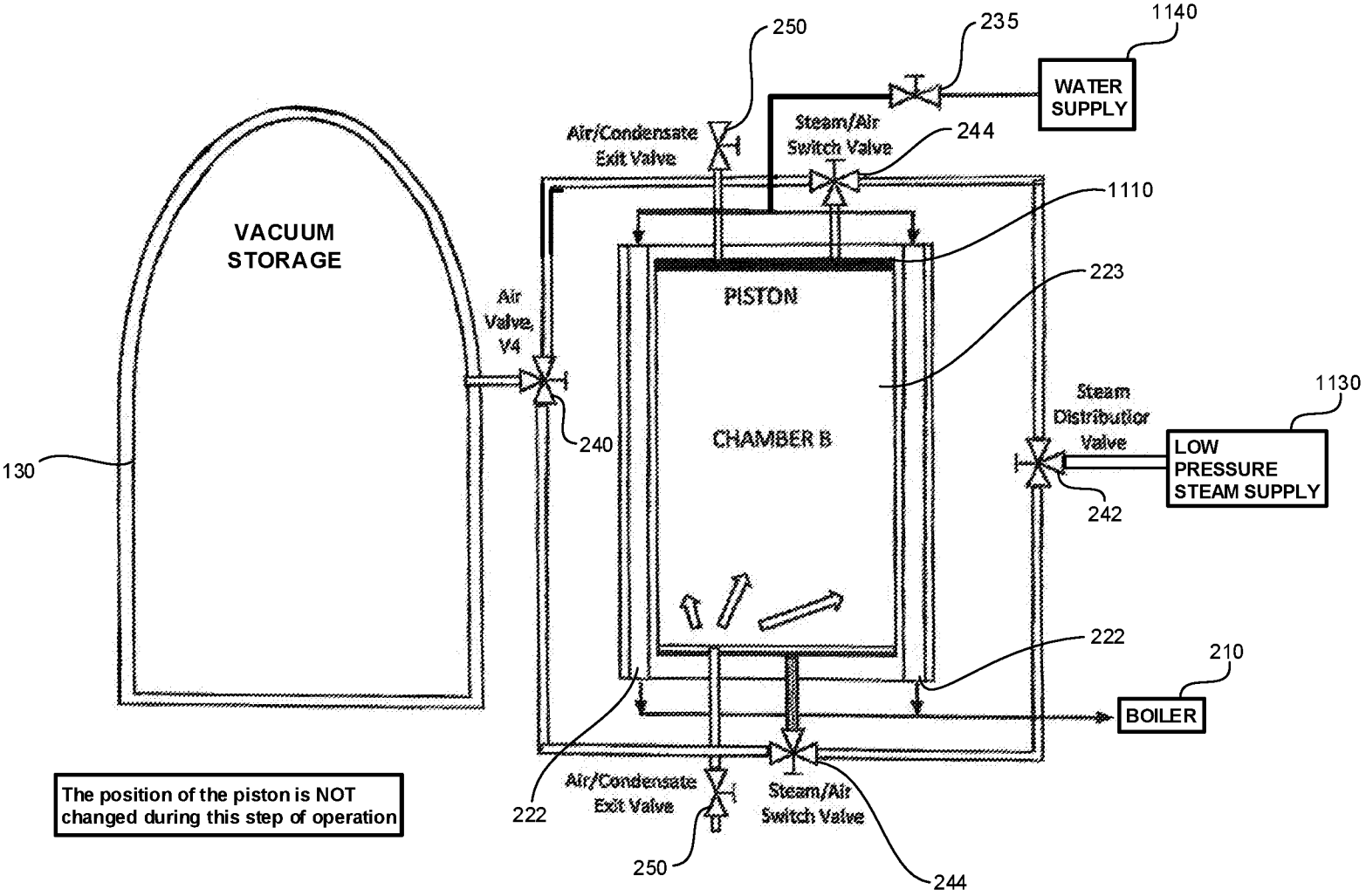

FIG. 22 illustrates chamber B 223 filled with content vacuumed from container 130. The position of the piston is not changed during this step of operation.

As previously described, after the above steps, one cycle of vacuum generation operation is completed. The cycle will repeat as long as needed for the vacuum storage or vacuuming container 130. When the same vacuum generation operation is used to create a prime mover or actuator, step A3 shown in FIG. 16, and step B3 shown in FIG. 22 are removed since the vacuum in the cylinder is no longer used for evacuate the application directly.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. A method for generating a vacuum with a dual-action piston cylinder vacuum generation system, comprising, completing at least one cycle of a vacuum generation operation with a dual-action piston cylinder vacuum generation system, wherein the one complete cycle includes:

(a) switching a steam distribution valve to a side A of a cylinder to allow flow of steam from the steam distribution valve into a chamber A of the cylinder, wherein steam pressure pushes a piston to move towards an end of a side B of the cylinder, and piston movement increases volume of the chamber A and fills the chamber A with the steam, while simultaneously the piston movement decreases volume of a chamber B, and compresses content of the chamber B and increases pressure inside the chamber B; and wherein when pressure inside the chamber B reaches an ambient pressure, an air and condensate exit valve is opened to allow air and condensate inside the chamber B to exit, and when the piston reaches to the end of side B, the air and condensate exit valve closes, and the chamber A is filled with the steam;

(b) opening a cold water supply valve to allow flow of cold water into a plurality of cylinder wall channels to induce condensation of steam inside the chamber A; wherein a continued condensation of steam reduces pressure inside the chamber A into a vacuum state; and once a vacuum level in the Chamber A reaches a predetermined level, the cold water supply valve is closed to stop flow of the cold water into the cylinder wall channels, and the chamber A is filled with a vacuum;

(c) switching an air valve to the side A of the cylinder, and switching a steam/air switch valve to allow air flow from an application volume into the cylinder, thereby allowing air to now enter into chamber A of the cylinder and increase the pressure inside chamber A, wherein when pressure inside the chamber A reaches a predetermined level, both the air valve and the steam/air switch valve will close; and the chamber A is filled with the air;

(d) switching the steam distribution valve to the side B of the cylinder and the steam/air switch valve to allow flow of steam from the steam distribution valve into the chamber A of the cylinder, wherein the steam pressure pushes the piston to move towards the end of the side A, and the piston movement increases the volume of chamber B and fills the chamber B with steam; and simultaneously the piston movement decreases the volume of chamber A, which compresses the chamber A content and increases the pressure inside chamber A; and when the pressure inside the chamber A reaches the ambient pressure, the air and condensate exit valve is opened to allow air and condensate inside the chamber A to exit; and when the piston reaches to the end of side A, the air and condensate exit valve closes, and the steam distribution valve and steam/air switch valve closes, and chamber B is filled with steam;

(e) opening the cold water supply valve to allow flow of the cold water into the cylinder wall channels to induce condensation of steam inside the chamber B, wherein the continued condensation of steam reduces pressure inside the chamber into a vacuum state; and once the predetermined vacuum level is reached, the cold water supply valve is closed to stop flow of cold water into the cylinder wall channels; and the chamber B is vacuum filled;

(f) switching the air valve to the side B of the cylinder, and switching the steam/air switch valve to allow flow of air from the application volume into the cylinder; wherein air is now entering into the chamber B of the cylinder and increases the pressure inside chamber B, and when pressure inside the chamber B reaches the predetermined level, both the air valve and the steam/air switch valve closes; and chamber B is filled with air; and removing steps (c), (d) and (f), when similar vacuum generation operation is used to create a prime mover or an actuator due to the vacuum in the cylinder is no longer used to evacuate the application directly.

2. The method of claim 1, further includes recycling a condensate that is expelled out of the chamber B.

3. The method of claim 1, further includes flowing liquid through a plurality of channels in a wall of the cylinder to perform a heat exchange with a content inside the cylinder.

4. A method of claim 1, further comprising:

providing a dual-action piston cylinder vacuum generation system that includes:

the cylinder including two chambers, the chamber A and the chamber B and the piston there between, and a cylinder wall, the cylinder operable to receive alternatively a first quantity and a second quantity of steam into the chamber A and the chamber B;

the plurality of cylinder wall channels in the cylinder wall operable to allow flows of hot and cold water through the channels to perform heat exchange with content inside the cylinder;

a plurality of atomizing spray nozzles to allow cold water into each of the chamber A and the chamber B alternately;

a steam and hot water generator to heat the cylinder wall and to provide the first and the second quantities of steam; a heat exchanger for the first and second quantities of steam to condense for a vapor-to-liquid phase change that reduces a pressure in the two chambers and provides a reduced pressure; and a rough vacuum storage in communication with the cylinder for depressurization to a rough vacuum state in the enclosed volume, wherein a rough vacuum and steam is utilized as actuation power for driving a vacuum pump; and wherein the vacuum generation system provides vacuum generation by having steam enter into the chamber A and moving the piston to push out air from chamber B;

filling the chamber A with steam and having the piston stationary with zero volume in chamber B;

entering a first quantity of cold water into the cylinder walls to induce condensation of steam inside the chamber A, and forcing hot water out of the cylinder walls;

spraying with the plurality of spray nozzles sprays cold water into chamber A, for producing condensation and creating a vacuum inside the chamber A;

transporting air in the enclosed volume or rough vacuum storage into chamber A by the created vacuum; and entering steam into the chamber B and moving the piston to push out air from chamber A to repeat vacuum generation.

5. The method of claim 1, further includes extracting a first quantity of gas from a vacuum storage or an open flow system into the chamber A, and utilizing a wall-embedded heat exchanger or channels disposed within the cylinder.

6. The method of claim 5, further includes using a water chiller in communication with the channels to condense the first and second quantities of steam.

7. The method of claim 5, further includes extracting a second quantity of gas from the enclosed volume or the open flow system into the chamber B, and repeating a dual action cycle by the inserting and the condensing of the first and the second quantities of steam in the chamber A and the chamber B to achieve a sustained vacuum generation.

8. The method of claim 1, wherein a reduction of pressure is generated with the chamber A and the chamber B that create a combination of a condensation cylinder and a vacuum compression cylinder.

9. The method of claim 8, wherein the condensing of the first and the second quantity of steam is through the heat exchanger in the chamber A and the chamber B of the condensation cylinder, respectively.

10. The method of claim 9, further includes moving a first piston and a first rod in the cylinder by a combination of a rough vacuum in the chamber A of the cylinder and steam in the chamber B of the cylinder.

11. The method of claim 10, further includes moving a second piston in the cylinder by a second rod coupled to the first rod of the cylinder.

12. The method of claim 11, further includes inserting a first quantity of gas from a vacuum storage into the chamber A of the cylinder.

13. The method of claim 12, further includes inserting a third quantity of steam into the chamber A of the cylinder.

14. The method of claim 13, further includes moving the first piston and the first rod in the cylinder by a combination of a rough vacuum in the chamber B of the cylinder and the steam in the chamber A of the cylinder.

15. The method of claim 14, further includes moving the second piston in the cylinder by the second rod coupled to the first rod of the cylinder.

16. The method of claim 15, further includes compressing the first quantity of gas in the chamber A of a vacuum compression cylinder into a rough vacuum storage.

17. The method of claim 16, further includes inserting a second quantity of gas from a high vacuum storage into the chamber B of the vacuum compression cylinder.

18. The method of claim 1, further includes reducing a pressure in the chamber A and the chamber B alternatively to provide a rough vacuum.

* * * * *